US010829829B2

(12) United States Patent
Andersen

(10) Patent No.: US 10,829,829 B2
(45) Date of Patent: Nov. 10, 2020

(54) APPARATUSES AND METHODS FOR STRETCHING A PELT ON A PELT BOARD

(71) Applicant: MINKPAPIR A/S, Holstebro (DK)

(72) Inventor: Mogens Fahlgren Andersen, Holstebro (DK)

(73) Assignee: MINKPAPIR A/S, Holstebro (DK)

( * ) Notice: Subject to any disclaimer, the term of this patent is extended or adjusted under 35 U.S.C. 154(b) by 147 days.

(21) Appl. No.: 16/080,485

(22) PCT Filed: Mar. 2, 2017

(86) PCT No.: PCT/EP2017/054901
§ 371 (c)(1),
(2) Date: Aug. 28, 2018

(87) PCT Pub. No.: WO2017/149074
PCT Pub. Date: Sep. 8, 2017

(65) Prior Publication Data

US 2019/0062853 A1 Feb. 28, 2019

(30) Foreign Application Priority Data

Mar. 2, 2016 (EP) ..... 16158239

(51) Int. Cl.
*C14B 15/06* (2006.01)

(52) U.S. Cl.
CPC ..... *C14B 15/06* (2013.01)

(58) Field of Classification Search
CPC ..... C14B 1/26; C14B 15/06; C14B 2700/21
See application file for complete search history.

(56) References Cited

U.S. PATENT DOCUMENTS 4,381,654 A 5/1983 Baldridge
4,787,221 A * 11/1988 Johansson ..... C14B 1/26 69/40

(Continued)

FOREIGN PATENT DOCUMENTS

DK 169525 11/1994
DK 200001174 2/2002

(Continued)

OTHER PUBLICATIONS

International Search Report on related PCT application (PCT/EP2018/067318) from International Searching Authority (EPO) dated Aug. 14, 2018.

(Continued)

*Primary Examiner* — Shaun R Hurley
(74) *Attorney, Agent, or Firm* — Klein, O'Neill & Singh, LLP

(57) ABSTRACT

A stretching apparatus for stretching a pelt on a pelt board and a method of stretching a pelt on a pelt board, where the pelt has a substantially tubular shape defining an inwardly oriented leather side, an outwardly oriented fur side, a nose end and a rear end. The pelt board defines a top end for accommodating and fixating the nose end of the pelt, a circumferential wall for facing the inwardly oriented leather side of the pelt and a base end located opposite the top end. The method comprises the steps of providing a stretching apparatus comprising a holding device, a fastening device comprising a gripping mechanism, and a drive mechanism connected between the holding device and the fastening device. The method further comprises holding the base end of a pelt board by the holding device so that the pelt board extends outwardly along a longitudinal direction from the holding device. Furthermore, the method comprises the fastening of the rear end of the pelt by using the gripping mechanism of the fastening device. The method also com- (Continued)

prises moving the holding device and the fastening device relative to each other in the longitudinal direction by using the drive mechanism for applying a stretching force onto the pelt by the drive mechanism corresponding to an estimated maximum stretching force value or more during a total time period.

17 Claims, 17 Drawing Sheets

(56) References Cited

U.S. PATENT DOCUMENTS

| | | | | |
|---|---|---|---|---|
| 4,945,736 | A | 8/1990 | Lagori et al. | |
| 6,915,669 | B2 * | 7/2005 | Hedegaard | C14B 1/26 69/19.3 |
| 7,900,488 | B2 * | 3/2011 | Hedegaard | C14B 15/06 69/19.1 |
| 2003/0019255 | A1 | 1/2003 | Hedegaard | |
| 2004/0060330 | A1 * | 4/2004 | Hedegaard | C14B 1/26 69/21 |
| 2007/0028655 | A1 * | 2/2007 | Hedegaard | C14B 15/06 69/21 |
| 2009/0007604 | A1 | 1/2009 | Hedegaard | |
| 2009/0019898 | A1 | 1/2009 | Hedegaard | |
| 2011/0041568 | A1 | 2/2011 | Sindersen et al. | |
| 2014/0007627 | A1 | 1/2014 | Pedersen | |
| 2014/0373577 | A1 | 12/2014 | Frolund | |
| 2016/0160300 | A1 * | 6/2016 | Pedersen | C14B 15/06 69/22 |
| 2018/0057900 | A1 * | 3/2018 | Andersen | C14B 15/06 |

FOREIGN PATENT DOCUMENTS

| | | |
|---|---|---|
| DK | 200001836 | 6/2002 |
| DK | 176683 | 2/2009 |
| DK | 177012 | 12/2010 |
| DK | 177149 | 2/2012 |
| EP | 1440171 | 9/2006 |
| EP | 1485507 | 11/2010 |
| EP | 1678331 | 12/2010 |
| EP | 2818563 | 12/2014 |
| EP | 2913410 | 9/2015 |
| EP | 3176271 | 6/2017 |
| EP | 3415645 | 12/2018 |
| WO | WO2002044428 | 6/2002 |
| WO | WO2005028682 | 3/2005 |
| WO | WO2005080607 | 9/2005 |
| WO | WO2006026986 | 3/2006 |
| WO | WO2007033681 | 3/2007 |
| WO | WO2008022644 | 2/2008 |
| WO | WO2008025364 | 3/2008 |
| WO | WO2012126467 | 9/2012 |
| WO | WO2015003919 | 1/2015 |
| WO | WO2015024788 | 2/2015 |

OTHER PUBLICATIONS

Written Opinion on related PCT application (PCT/EP2018/067318) from International Searching Authority (EPO) dated Aug. 14, 2018.

International Search Report on corresponding PCT application (PCT/EP2016/056215) from International Searching Authority (EPO) dated Jun. 13, 2016.

Written Opinion on corresponding PCT application (PCT/EP2016/056215) from International Searching Authority (EPO) dated Jun. 13, 2016.

Non-Final Office Action on co-pending US application (U.S. Appl. No. 15/561,223) dated Aug. 29, 2019.

International Search Report on corresponding PCT application (PCT/EP2017/054901) from International Searching Authority (EPO) dated Jun. 12, 2017.

Written Opinion on corresponding PCT application (PCT/EP2017/054901) from International Searching Authority (EPO) dated Jun. 12, 2017.

* cited by examiner

APPARATUSES AND METHODS FOR STRETCHING A PELT ON A PELT BOARD

CROSS-REFERENCE TO RELATED APPLICATIONS

This application is the national phase entry, under 35 U.S.C. Section 371(c), of International Application No. PCT/EP2017/054901, filed Mar. 2, 2017, claiming priority from European Patent Application No. 16158239.0, filed Mar. 2, 2016. The disclosures of the International Application and the European Application from which this application claims priority are incorporated herein by reference in their entirety.

FEDERALLY SPONSORED RESEARCH OR DEVELOPMENT

Not Applicable

BACKGROUND OF THE INVENTION

In the fur industry, animal pelts are often stretched in a non-destructive way in order to maximize the size of the pelt. The pelts define a substantially tubular shape and have an outwardly oriented fur side and an inwardly oriented leather side. The stretching is taking place after skinning the animal and scraping off the layer of fat on the leather side of the pelt and before the drying of the pelt. In the present context, the word pelt is understood to encompass pelts of minks, foxes and similar small mammals. The pelts are often stretched on a pelt board, which is often made of wood or plastic. Normally, the leather side of the pelt is facing the surface of the pelt board and the pelt board may in addition be provided with a fat absorbing material such as paper which is in contact with the leather side of the pelt. The fur side of the pelt is thereby facing outwardly during the stretching and drying of the pelt.

The stretching procedure and the use of pelt boards is known per se and both are disclosed in e.g. WO 2005/028682 A1. Therein is disclosed the use of a gripping element which is brought in engagement with the whole periphery of the pelt and the drawing of a fixing bag over the outside of the pelt in order to maintain the pelt in a stretched configuration during the drying of the pelt. Thereby, the previous use of staples and the thus produced elongated holes in the pelts may be avoided.

In relation to the above terminology, the word bag which in its normal understanding may describe a sleeve with a closed off bottom should in the present circumstances and further along in the present patent application be understood to also encompass sleeves which are not closed off and which have a tubular or cylindrical shape without a closed off bottom.

WO 2006/026986 A1 discloses a help arrangement for clamping the nose end of a pelt to a pelt board.

WO 2007/033681 A2 discloses a method and machine for the folding out of the tail part of the pelt in connection with the stretching of the pelt on the pelt board.

WO 2008/025364 A1 relates to a method and machine for performing water brushing of tanned pelts in order to achieve a more presentable appearance of the pelt.

WO 02/44428 A1 relates to another method and machine for stretching of a pelt on a pelt board. The pelt is secured in the stretched positing by means of a sleeve or bag which is drawn over and around the pelt board, so that the pelt is pressed and locked against the pelt board. This method, which is also described above, is nowadays used as a standard method for fixing the pelt in the stretched position in a non-damaging way.

DK 169 525 B1 discloses a machine for stretching a pelt. The machine includes a gripping mechanism for holding the pelt. Magnetic sensors are used for controlling the extent of stretching of the pelt by the gripping mechanism.

DK 2000 01174 L discloses another method in which the stretched pelt is held in place in a non-destructive way by the use of a pelt bag or sleeve.

EP 2 818 563 A1 discloses a hair controller for mounting on a stretching machine. The controller utilizes a nozzle or orifice for providing a stream of air.

US 2003/0019255 A1 discloses yet another method for fastening a pelt on a pelt board after stretching by the use of a sleeve or bag, and a corresponding sleeve for use with the method.

WO 2008/022644 A1 discloses a tube-shaped holding bag which is drawn over the fur side of the pelt for holding the pelt in a stretched position.

DK 177149 B1 corresponding to WO 2012/126467 A discloses a method of repeatedly measuring of the length of the pelt for the determination of the force to be used in a subsequent stretching EP 1 485 507 B1 discloses a repetitive process in which a pelt is stretched initially in a wet condition, thereafter it is finally stretched once more in the dry state.

DK 2000 01836 L describes an automatic detection and measurement of the length of the pelt.

EP 1 440 171 B1 describes a technique in which pelts that are not mounted on a board are stretched during a process in which stretching occurs both in the wet and the dry state with intermediate drying.

U.S. Pat. No. 4,945,736 discloses an apparatus for stretching hides on a drawing frame.

U.S. Pat. No. 4,381,654 also describes an apparatus for stretching a hide that is held on a board. The stretching is made as a one-step process.

EP 1 678 331 A1 disclose a pelt stretching apparatus including a vibrator with a vibration amplitude in the longitudinal direction.

It has been realized that by stretching of the pelt according to the above prior art technologies by gripping the lower end of the pelt, i.e. the tail end of the pelt, most of the stretching force is applied to the lower part of the pelt, i.e. the part of the pelt closest to the tail end of the pelt, and less force is applied to the upper part of the pelt, i.e. the part of the pelt which is closest to the nose part of the pelt. This is contrary to the anatomy of the pelt since the upper part of the pelt would normally be capable of withstanding a larger force than the lower part of the pelt. The pelt will thus not be stretched in an optimal way by applying the stretching force is applied to the lower part of the pelt. It is thus an object according to the present invention to provide technologies for properly stretching of both the upper part of the pelt as well as the lower part of the pelt.

Further, in connection with the stretching of the lower part of the pelt it has been realized that placing the pelt board including the pelt in a proper stretching position is difficult due to the fact that the gripping mechanism, which is intended to fasten the pelt about its complete contour, i.e. both the back side contour and leg side contour, obstructs the access of the user. Thus, it is an object according to the present invention to provide technologies for simplifying the access of the user to the stretching apparatus.

Yet further, it has been realized that the stretching operation and in particular the fine tuning of the gripping mechanisms require the user to hold one hand on the pelt which the other hand is operating the user interface of the stretching apparatus. This is disadvantageous in relation to the alignment of the pelt in the stretching apparatus and it would be advantageous if the user could be able to use two hands holding the pelt instead of only one hand. Thus, it is an object according to the present invention to provide technologies for allowing the user to operate the stretching apparatus while keeping both hands on the pelt.

The price of a pelt is calculated based on the length of the pelt, i.e. the longer the pelt is the more valuable it is. For the purpose of calculating the price of a pelt, a number of length classes has been defined. Consequently, the value of the pelt is depending on in which length category the pelt is classified in. To counter the fact that the length of the pelt will be slightly reduced after drying, the pelts are stretched before being fastened onto the pelt board. The longer the pelt is stretched before drying, the longer the pelt will be after drying.

The applicant has made numerous stretching experiments for analyzing the deformation/stretching of the pelt during various stretching modes. Both WO 02/44428 A1 and EP 1 678 331 A1 suggest the use of vibrators which introduce jerks and jolts in the longitudinal direction of the pelts. The use of vibrators has resulted in a possible increase in the length of the pelt of about 5%.

It has been realized that the stretching of the pelt includes an elastic deformation component and at least one further deformation component up to the point where hair from the pelt will loosen and fall off and/or the stretching force exceeds the internal strength of the pelt at which point the pelt will tear apart. Thereby, it is well known that the elastic deformation component is entirely depending on the applied force without any dependence on any prior stretching of the pelt. Thus, the higher the applied stretching force, the longer the pelt will be in a substantially linear relationship.

On the other hand, the further deformation component may include deformation components which depend on any prior stretching of the pelt. Such further deformation components may include plastic deformation, viscoelastic deformation, creep deformation and deformation resulting from the loosening of bondings such as fibre bondings within the pelt or any other similar types of deformation. Whereas elastic deformation is linear, substantially non-permanent and substantially non-time dependent, the other types of deformations are non-linear, time dependent and of a more permanent nature than the previously discussed elastic deformation. All of these non-linear deformations will collectively from now on be referred to as non-linear deformations and should in particular be understood to include plastic deformation.

Non-linear deformation in the present context should be understood as meaning that an increase in the stretching force of delta F does not result in a constant deformation length delta L, as would be the case for elastic deformation. Time dependent deformation should be understood as a deformation which is dependent from not only the stretching force applied but also from prior deformations and/or the amount of time said stretching force is applied.

The applicant has made numerous proof-of-concept experiments and found out that the non-linear and time dependent effects are most significant at high stretching forces which approach the tear strength of the pelt. Further, the non-linear and time dependent stretching normally co-exist with the linear and non-time dependent stretching. Time dependent deformation is understood as deformation not only dependent of the force applied but also on the time which the force has been applied.

From the above experiments the applicant has made two conclusions:

Firstly, it has been realized that a longer pelt may be achieved by repetitively stretching the pelt with a high stretching force and for each subsequent stretching, a higher stretching force may be applied, even up to and beyond stretching force which would have torn the pelt apart if it would have been applied without any initial stretching using smaller stretching forces.

Secondly, it has been realized that even using a constant magnitude of the stretching force, a longer pelt may be achieved by stretching the pelt with a high stretching force during a long time period comparing to stretching the pelt with an equally high stretching force during a shorter time period.

Thus, it is the object of the present invention to provide technologies for stretching pelts beyond the previously known limits. The advantage of such additional stretching is that the pelt after drying will assume an increased length, and thus an increased value, without any noticeable reduction of pelt quality.

SUMMARY OF THE INVENTION

At least the above object or at least one of numerous further objects, which will be evident from the below description of the present invention, is according to one aspect of the present invention obtained by a stretching apparatus for stretching a pelt on a pelt board, the pelt having a substantially tubular shape defining an inwardly oriented leather side, an outwardly oriented fur side, a nose end, a rear end and a pair of front leg cavities, the pelt board defining a top end for accommodating and fixating the nose end of the pelt, a circumferential wall for facing the inwardly oriented leather side of the pelt and a base end located opposite the top end, the stretching apparatus comprising:

- a holding device for holding the base end of the pelt board, and
- a stretching device having a pair of stretching members, each of the stretching members being adapted for being inserted into a respective front leg cavity of the pelt, the stretching device being movable in a direction towards the holding device for stretching the pelt.

The pelt, the pelt board and how the pelt is mounted on the pelt board, have been described in detail above. The front leg cavities arise in the pelt after skinning and cutting off the paws of the animal. The front leg cavities may comprise smaller tubular pelt parts which originally covered the front legs of the animal and which are normally inverted and folded inwardly to be positioned between the leather side of the pelt and the pelt board in order for these parts to be dried out as well. On the outside of the pelt when mounted on the pelt board, cavities thus appear which have been designated front leg cavities.

The holding device is configured for holding the base end of the pelt board in a fixated position and preferably in a vertical orientation such that the pelt board extends upwardly from the holding device and consequently, the pelt extends on the pelt board from a rear end adjacent the holding device to a nose end pointing upwardly and away from the holding device.

The pair of stretching members of the stretching device may be inserted into a respective front leg cavity and thus at least partially enter the leg portion of the pelt which as explained above has been inverted. By moving the stretching member towards the holding device, typically downwardly, the pelt will be stretched since the stretching members will cause the leg cavities to move along with the stretching members, thereby inducing a stretching force onto the upper part of the pelt, i.e. the part of the pelt being closest to the nose end. Thereby the pelt may be stretched in a non-destructive way without needing to fasten any part of the pelt and allowing air to still access all parts of the leather side of the pelt. Typical forces involved are about 100-150N for achieving a proper non-destructive stretching of the upper part of the pelt.

According to a further embodiment of the above aspect, the stretching members comprise cylindrical pins. Such cylindrical pins will be advantageous for entering the leg cavities and applying the stretching force in a non-destructive way.

According to a further embodiment of the above aspect, the apparatus comprises a first fastening device for fastening the rear end of the pelt, the first fastening device being movable in a direction towards the holding device for stretching the pelt. Preferably, also the lower end of the pelt is stretched simultaneously with the upper part of the pelt. The stretching of the lower part of the pelt may be performed according to the prior art or as will be described further below. Generally, the rear end, of the pelt is fastened to a fastening device which is then moved in a direction towards the holding device, i.e. generally downwardly. The fastening device should fasten the pelt along its complete contour and not only the tail and rear legs, since otherwise the non fastened parts of the contour of the lower end will not be stretched and may on the contrary be contracted, yielding a lower price for the pelt.

According to a further embodiment of the above aspect, the apparatus comprises a second fastening device for fastening a tail part extending from the rear end of the pelt, the second fastening device being movable in a direction towards the holding device for stretching the pelt. It may in addition to the above be advantageous to stretch the tail part since the tail forms part of a very dense connective tissue which extends from the tail part along the back side of the pelt to the nose part, which tissue may be capable of withstanding a larger stretching force.

According to a further embodiment of the above aspect, the apparatus comprises a third fastening device for fastening and fixating the nose end of the pelt, the third fastening device being movable in a direction towards the holding device for stretching the pelt. Optionally, the nose end may be fixated and moved in a direction away from the holding device, i.e. typically upwardly. Since the stretching force is applied to the pelt board, the rigidness of the pelt board sets a final limit on the amount of stretching which may be applied to the pelt, since a too large stretching force will cause the pelt board to bend and any additional stretching will not stretch the pelt but further bend the pelt board. To avoid this and relieve the stress on the pelt board, the nose end may be moved in the opposite direction of the stretching force, thereby relieving the pelt board and allowing a higher total stretching force.

According to a further embodiment of the above aspect, the stretching device, the first fastening device and/or the second fastening device and/or the third fastening device is/are movable by means of a pneumatic drive, a hydraulic drive or a spindle drive. The above drive mechanisms may be used for an efficient and accurate stretching to be performed.

According to a further embodiment of the above aspect, the first fastening device and/or the second fastening device comprise opposing gripping members for gripping the pelt between the inwardly oriented leather side and the outwardly oriented fur side. In order to achieve a firm fastening of the rear end of the pelt, the pelt is preferably gripped between opposing gripping members.

According to a further embodiment of the above aspect, the holding device, the stretching device, the first fastening device, the second fastening device and/or the third fastening device comprise one or more vibration actuators for inducing one or more oscillations onto the pelt. By vibrating the pelt at the same time as it is being stretched, i.e. inducing an oscillating movement into the pelt, the fibers in the pelt tissue may additionally loosen in a non-destructive way allowing the pelt to be stretched further than by just applying the stretching force in a single direction.

According to a further embodiment of the above aspect, the vibration actuator will be operating at a frequency of between 1 Hz and 100 Hz. Such frequencies will be advantageous for obtaining the above effect.

According to a further embodiment of the above aspect, the stretching device, the first fastening device, the second fastening device and/or the third fastening device comprise a compressed air outlet for temporarily removing any fur hair located adjacent the compressed air outlet. By allowing a stream of compressed air to be directed toward the area of the pelt which will be fastened by the stretching device and/or fastening device where present, the area of contact between these devices and thereby the area of the pelt at which the stretching force is applied will be free from hair and thus the hair originally covering these areas will remain essentially unaffected and undamaged by the stretching.

According to a further embodiment of the above aspect, the stretching apparatus further comprises a holding bag applicator. The holding bag may be applied automatically onto the pelt board after the stretching has been completed by the use of a holding bag applicator.

According to a further embodiment of the above aspect, the base end of the pelt board comprises a connecting element and the holding device comprises a locking part for locking the connecting element to the holding device. Thereby the pelt board remains in a substantially fixated and upright position during stretching and the risk of bending the pelt board during stretching is thereby reduced.

According to a further embodiment of the above aspect, the pair of stretching members is interconnected by a rack and pinion actuator. In this way, the stretching members may be adapted to different widths between the front leg cavities for different pelts.

At least the above object or at least one of numerous further objects which will be evident from the below description of the present invention, is according to one aspect of the present invention obtained by a stretching apparatus for stretching a pelt on a pelt board, the pelt having a substantially tubular shape defining an inwardly oriented leather side, an outwardly oriented fur side, a nose end, a rear end and a pair of front leg cavities, the pelt board defining a top end for accommodating and fixating the nose end of the pelt, a circumferential wall for facing the inwardly oriented leather side of the pelt and a base end located opposite the top end, the pelt further defining a contour constituting a leg side contour and a back side contour, the stretching apparatus comprising:

a holding device for holding the base end of the pelt board, the stretching apparatus defining a pelt board space extending outwardly along a longitudinal direction from the holding device for accommodating the pelt board, a stretching device having a pair of stretching members, each of the stretching members being adapted for being inserted into a respective front leg cavity of the pelt, the stretching device being movable in a direction towards the holding device for stretching the pelt, and a fastening device, the fastening device comprising a first gripping mechanism for fastening the rear end of the pelt along either the back side contour or the leg side contour, and a second gripping mechanism for fastening the rear end of the pelt along either the leg side contour or the back side contour, respectively, the first gripping mechanism and the second gripping mechanism being movable in the longitudinal direction and the second gripping mechanism additionally being movable between a first position, in which the first gripping mechanism and the second gripping mechanism are located on the same side of the pelt board space, and a second position, in which the first gripping mechanism and the second gripping mechanism are located on opposite sides of the pelt board space.

The above aspect is preferably used for achieving a complete stretching of both the upper part and the lower part of the pelt.

At least the above object or at least one of numerous further objects, which will be evident from the below description of the present invention, is according to one aspect of the present invention obtained by a method of stretching a pelt on a pelt board comprising performing the steps of:

providing the pelt and the pelt board, the pelt having a substantially tubular shape defining an inwardly oriented leather side, an outwardly oriented fur side, a nose end, a rear end and a pair of front leg cavities, the pelt board defining a top end for accommodating and fixating the nose end of the pelt, a circumferential wall for facing the inwardly oriented leather side of the pelt and a base end located opposite the top end, providing a stretching apparatus comprising a holding device and a stretching device, the stretching device having a pair of stretching members, holding the base end of a pelt board by the holding device, inserting each of the stretching members of the stretching device into a respective front leg cavity of the pelt, and moving the stretching device in a direction towards the holding device, thereby stretching the pelt.

The above method is preferably used together with the above apparatuses.

At least the above object or at least one of numerous further objects which will be evident from the below description of the present invention, is according to one aspect of the present invention obtained by a stretching apparatus for stretching a pelt on a pelt board, the pelt having a substantially tubular shape defining an inwardly oriented leather side, an outwardly oriented fur side, a nose end and a rear end, the pelt board defining a top end for accommodating and fixating the nose end of the pelt, a circumferential wall for facing the inwardly oriented leather side of the of the pelt and a base end located opposite the top end, the pelt further defining a contour constituting a leg side contour and a back side contour, the stretching apparatus comprising:

a holding device for holding the base end of the pelt board, the stretching apparatus defining a pelt board space extending outwardly along a longitudinal direction from the holding device for accommodating the pelt board, and a fastening device, the fastening device comprising a first gripping mechanism for fastening the rear end of the pelt along either the back side contour or the leg side contour, and a second gripping mechanism for fastening the rear end of the pelt along either the leg side contour or the back side contour, respectively, the first gripping mechanism and the second gripping mechanism being movable in the longitudinal direction and the second gripping mechanism additionally being movable between a first position, in which the first gripping mechanism and the second gripping mechanism are located on the same side of the pelt board space, and a second position, in which the first gripping mechanism and the second gripping mechanism are located on opposite sides of the pelt board space.

The pelt and the pelt board have been described in detail above. The pelt has a substantially tubular shape having four leg parts on a leg side and a back side opposite the leg side. The pelt defines a rear end which is understood to be the part of the pelt where the tail part and the rear leg parts are located. The contour of the pelt is in the present context understood to constitute the circumference of the pelt, which is divided into a leg side contour and a back side contour, each constituting approximately a half part of the full contour.

The holding device is holding the base end of the pelt board in a fixated position and preferably in a vertical orientation such that the pelt board extends upwardly from the holding device and consequently, the pelt extends on the pelt board from a rear end adjacent the holding device to a nose end pointing upwardly and away from the holding device. The holding device thus defines a pelt board space in the stretching apparatus which should be unobstructed for allowing the pelt board to be fitted correctly.

The first gripping mechanism fixates the rear end of the pelt along any one of the leg side contour or the back side contour, preferably the back side contour. Thereby it is preferable that the complete half part of the contour is fixated by the first gripping mechanism for achieving a uniform stretching of the pelt. The first gripping mechanism is preferably located spaced apart from the user. The first and the second gripping mechanisms are movable synchronously in a longitudinal direction by means of a driving mechanism located behind the first gripping mechanism in order to adjust the position of the gripping mechanisms and for performing the stretching.

The second gripping mechanism is movable between a first position constituting a mounting position which is used for simplifying the placement of the pelt board in the holding device and simplifying the accessing of the pelt board's space, and a second position which is a stretching position which is used when the apparatus is stretching the pelt. In the first position, the second gripping mechanism is located behind the pelt board space and preferably beside the first gripping mechanism allowing the user to freely access the pelt board space for placing the pelt board in the correct position. In the second position, the second gripping mechanism is located on the opposite side of the pelt board space such that the pelt board when mounted in the holding device is located between the first gripping mechanism and the second gripping mechanism.

When the first gripping mechanism has been fastened to the rear end of the pelt, the second gripping mechanism is moved from the first position to the second position and thereafter the second gripping mechanism is fastened to the rear end of the pelt along the contour which is not already fixated by the first gripping mechanism, preferably being the leg side contour. Thereafter the stretching of the pelt is initiated.

According to a further embodiment of the above aspect, the first gripping mechanism is fastening the rear end of the pelt along the back side contour and the second gripping mechanism is fastening the rear end of the pelt along the leg side contour. Preferably, the pelt board leg side is facing the user during the fixation.

According to a further embodiment of the above aspect, the first gripping mechanism and/or the second gripping mechanism comprise a gripping element and an opposite holding element, the gripping element being movable in relation to the holding element in order to pin the rear end of the pelt between the gripping element and the holding element. Preferably, the pelt is pinned between the gripping element and the holding element which are movable to pin the pelt between the fur side and the leather side.

According to a further embodiment of the above aspect, the second gripping mechanism comprises a first half part and a second half part, each half part being adapted for gripping approximately a quarter of the contour. Each half part may be moves separately between the first position and the second position.

According to a further embodiment of the above aspect, when in the first position, the first half part and a second half part are located on opposite sides of the pelt board space.

Thus, the first half part and the second half part are located on opposite sides of the first gripping mechanism when in the first position.

According to a further embodiment of the above aspect, the movement between the first position and the second position involves a linear movement and a rotational movement of the second gripping mechanism. Preferably, the second mechanism when moved from the first position to the second position is first pulled forward and then rotated to face the pelt board in the pelt board space in the second position. After mounting and stretching, the procedure is reversed before the pelt board is removed.

According to a further embodiment of the above aspect, the holding device and/or the fastening device comprise a vibration actuator for inducing an oscillation onto the pelt. By vibrating the pelt at the same time as it is being stretched, i.e. inducing an oscillating movement into the pelt, the fibers in the pelt tissue may additionally loosen in a non-destructive way allowing the pelt to be stretched further than by just applying the stretching force in a single direction.

According to a further embodiment of the above aspect, the vibration actuator operates at a frequency of between 1 Hz and 100 Hz. Such frequencies will be advantageous for obtaining the above effect.

According to a further embodiment of the above aspect, the stretching apparatus further comprises a holding bag applicator. The holding bag may be applied automatically onto the pelt board after the stretching has been completed by the use of a holding bag applicator.

According to a further embodiment of the above aspect, the base end of the pelt board comprises a connecting element and the holding device comprises a locking part for locking the connecting element to the holding device. Thereby the pelt board remains in a substantially fixated and upright position during stretching and the risk of bending the pelt board during stretching is thereby reduced.

According to a further embodiment of the above aspect, the fastening device comprises a compressed air outlet for temporarily removing any fur hair located adjacent the compressed air outlet. By allowing a stream of compressed air to be directed toward the area of the pelt which will be fastened by the stretching device and/or fastening device, where present, the area of contact between these devices and thereby the area of the pelt at which the stretching force is applied will be free from hair and thus the hair originally covering these areas will remain essentially unaffected and undamaged by the stretching.

According to a further embodiment of the above aspect, the holding device and/or the fastening device is/are movable by means of a pneumatic drive, a hydraulic drive or a spindle drive. The above drive mechanisms may be used for an efficient and accurate stretching to be performed.

According to a further embodiment of the above aspect, the fastening device comprises a laser for generating a visual alignment line on the pelt. In this way, the positioning of the pelt will be simplified as the user will be aided in the alignment of the pelt. The correct positioning is critical for achieving a correct stretching of the pelt and avoid any misalignment of the pelt caused by bad positioning of the pelt in the fastening mechanism.

At least the above object or at least one of numerous further objects which will be evident from the below description of the present invention, is according to one aspect of the present invention obtained by a stretching apparatus for stretching a pelt on a pelt board, the pelt having a substantially tubular shape defining an inwardly oriented leather side, an outwardly oriented fur side, a nose end, a rear end and a pair of front leg cavities, the pelt board defining a top end for accommodating and fixating the nose end of the pelt, a circumferential wall for facing the inwardly oriented leather side of the of the pelt and a base end located opposite the top end, the pelt further defining a contour constituting a leg side contour and a back side contour, the stretching apparatus comprising:

- a holding device for holding the base end of the pelt board, the stretching apparatus defining a pelt board space extending outwardly along a longitudinal direction from the holding device for accommodating the pelt board,
- a stretching device having a pair of stretching members, each of the stretching members being adapted for being inserted into a respective front leg cavity of the pelt, the stretching device being movable in a direction towards the holding device for stretching the pelt, and
- a fastening device, the fastening device comprise a first gripping mechanism for fastening the rear end of the pelt along either the back side contour or the leg side contour, and a second gripping mechanism for fastening the rear end of the pelt along either the leg side contour or the back side contour, respectively, the first gripping mechanism and the second gripping mechanism being movable in the longitudinal direction and the second gripping mechanism additionally being movable between a first position in which the first gripping mechanism and the second gripping mechanism being located on the same side of the pelt board space, and a second position in which the first gripping mechanism and the second gripping mechanism being located on opposite sides of the pelt board space.

The above aspect is preferably used for achieving a complete stretching of both the upper part and the lower part of the pelt.

At least the above object or at least one of numerous further objects which will be evident from the below description of the present invention, is according to one aspect of the present invention obtained by a method of stretching a pelt on a pelt board, the pelt having a substantially tubular shape defining an inwardly oriented leather side, an outwardly oriented fur side, a nose end and a rear end, the pelt board defining a top end for accommodating and fixating the nose end of the pelt, a circumferential wall for facing the inwardly oriented leather side of the of the pelt and a base end located opposite the top end, the pelt further defining a contour constituting a leg side contour and a back side contour, the method comprising the steps of:

providing a stretching apparatus comprising a holding device and a fastening device, the fastening device comprise a first gripping mechanism and a second gripping mechanism, holding the base end of a pelt board by the holding device so that the pelt board extending outwardly along a longitudinal direction from the holding device, moving the first gripping mechanism and the second gripping mechanism along the longitudinal direction, fastening the rear end of the pelt along either the back side contour or the leg side contour by using the first gripping mechanism, moving the second gripping mechanism from an initial first position in which the first gripping mechanism and the second gripping mechanism being located on the same side of the pelt board to a second position in which the first gripping mechanism and the second gripping mechanism being located on opposite sides of the pelt board, and fastening the rear end of the pelt along either the leg side contour or the back side contour, respectively.

The above method is preferably used with the above apparatuses.

At least the above object or at least one of numerous further objects which will be evident from the below description of the present invention, is according to one aspect of the present invention obtained by a stretching apparatus for stretching a pelt on a pelt board, the pelt having a substantially tubular shape defining an inwardly oriented leather side, an outwardly oriented fur side, a nose end and a rear end, the pelt board defining a top end for accommodating and fixating the nose end of the pelt, a circumferential wall for facing the inwardly oriented leather side of the of the pelt and a base end located opposite the top end, the stretching apparatus comprising:

a holding device for holding the base end of the pelt board, and a fastening device comprise a gripping mechanism for fastening the rear end of the pelt, the fastening device further comprise a drive mechanism for moving the first fastening device relative to the holding device and for positioning the rear end of the pelt within the gripping mechanism, the gripping mechanism being controlled by a first user interface and the drive mechanism being controlled by a second user interface, the first user interface and/or the second user interface being located a distance of less than 30 cm from the gripping mechanism.

The pelt and the pelt board have been described in detail above. The holding device is holding the base end of the pelt board in a fixated position and preferably in a vertical orientation such that the pelt board extends upwardly from the holding device and consequently the pelt extends on the pelt board from a rear end adjacent the holding device to a nose end pointing upwardly and away from the holding device. The gripping mechanism fixates the rear end of the pelt along its contour between the fur side of the pelt and the leather side of the pelt. It is thereby important that the complete tubular contour of the pelt is fixated as the pelt otherwise may be skewed during stretching.

The gripping mechanism thus comprise two distinct states, namely a fixated state where the gripping mechanism is fixating the rear end of the pelt, and a non-fixated state where the pelt is loose relative to the gripping mechanism. In order for the pelt to be put into the correct position, the gripping mechanism is initially in the loose state allowing the user to insert the rear end of the pelt between gripping members of the gripping mechanism. The user may fine tune the position by hand and by moving the complete fastening device including the gripping device including towards or away from the holding device by using the drive mechanism, the user may position the rear end of the pelt in the correct longitudinal position.

The gripping mechanism is controlled by a first user interface and the drive mechanism is controlled by a second user interface, which both should be positioned such that the user may operate both the user interfaces while still keeping the hands on the pelt for ensuring that the correct alignment of the rear end of the pelt is kept while the user is changing the position of the fastening device by using the same hands. This may be achieved by locating both the user interfaces a distance of less than 30 cm from the gripping mechanism.

In this way the user may hold both hands on the rear end of the pelt and simultaneously adjust the gripping mechanism to the correct position and fasten the pelt to the gripping mechanism while maintaining both hands on the pelt.

According to a further embodiment of the above aspect, the first user interface and/or the second user interface is located less than 30 cm from the gripping mechanism, preferably less than 20 cm, more preferably less than 10 cm, most preferably less than 5 cm. More advantageously, the first user interface, the second user interface or both user interfaces are located even closer to the gripping mechanism, such as the distances indicated above.

According to a further embodiment of the above aspect, the first user interface and/or the second user interface comprise a proximity sensor, such as a photo detector or an IR sensor. Preferably, touch or contact free interfaces are used, which eliminates the need of the user to actuate a button or the like with the limited capabilities of moving the hand which the user has when already holding the rear end of the pelt and attempting to position it in the correct position relative to the gripping mechanism.

According to a further embodiment of the above aspect, the first user interface and/or the second user interface comprise a pressure sensor, a resistive sensor or a capacitive sensor. Alternatively, a touch sensor is used. In this way unintentional activation of the sensor may be avoided.

According to a further embodiment of the above aspect, the second user interface comprises a first sensor for causing the drive mechanism to move the fastening device away from the holding device, and a second sensor for causing the drive mechanism to move the fastening device towards the holding device. The second user interface is preferably split into two separate sensors for controlling individually the two different directions of the drive mechanism. The two sensors are preferably located on opposite sides of the gripping mechanism such that each sensor may be maneuvered by a separate hand.

According to a further embodiment of the above aspect, the distance between the gripping mechanism and the holding mechanism is unobstructed and/or the stretching apparatus enables a human user to simultaneously reach both the gripping mechanism and the holding mechanism by the same hand. Preferably, the user interfaces are positioned without any obstructions between the user interfaces and the gripping mechanism in order to improve the user's ability to reach the user interfaces while manipulating the rear end of the pelt.

According to a further embodiment of the above aspect, the holding device and/or the fastening device comprises a vibration actuator for inducing an oscillation onto the pelt. By vibrating the pelt at the same time as it is being stretched, i.e. inducing an oscillating movement into the pelt, the fibers in the pelt tissue may additionally loosen in a non-destructive way allowing the pelt to be stretched further than by just applying the stretching force in a single direction.

According to a further embodiment of the above aspect, the vibration actuator operates at a frequency of between 1 Hz and 100 Hz. Such frequencies will be advantageous for obtaining the above effect.

According to a further embodiment of the above aspect, the stretching apparatus further comprises a holding bag applicator. The holding bag may be applied automatically onto the pelt board after the stretching has been completed by the use of a holding bag applicator.

According to a further embodiment of the above aspect, the base end of the pelt board comprises a connecting element and the holding device comprises a locking part for locking the connecting element to the holding device. Thereby the pelt board remains in a substantially fixated and upright position during stretching and the risk of bending the pelt board during stretching is thereby reduced.

According to a further embodiment of the above aspect, the fastening device comprise a compressed air outlet for temporarily removing any fur hair located adjacent the compressed air outlet. By allowing a stream of compressed air to be directed toward the area of the pelt which will be fastened by the stretching device and/or fastening device where present, the area of contact between these devices and thereby the area of the pelt at which the stretching force is applied will be free from hair and thus the hair originally covering these areas will reaming essentially unaffected and undamaged by the stretching.

According to a further embodiment of the above aspect, the holding device and/or the fastening device is movable by means of a pneumatic drive, a hydraulic drive, an electric drive or a spindle drive. The above drive mechanisms may be used for an efficient and accurate stretching to be performed.

According to a further embodiment of the above aspect, the fastening device comprises a laser for generating a visual alignment line on the pelt. In this way the positioning of the pelt will be simplified as the user will be aided in the alignment of the pelt. The correct positioning is critical for achieving a correct stretching of the pelt and avoids any misalignment of the pelt caused by incorrect positioning of the pelt in the fastening mechanism.

According to a further embodiment of the above aspect, the fastening device comprise opposing gripping members for gripping the pelt between the inwardly oriented leather side and the outwardly oriented fur side. The gripping members initially assume the non-fixated position when the rear end of the pelt is inserted between the gripping members and the drive mechanism is used for positioning the gripping mechanism at the rear end of the pelt. The fixated position is used when the rear end of the pelt if fixated between the opposing gripping element for stretching the pelt.

At least the above object or at least one of numerous further objects which will be evident from the below description of the present invention, is according to one aspect of the present invention obtained by a method of stretching a pelt on a pelt board comprising performing the steps of:

providing the pelt and the pelt board, the pelt having a substantially tubular shape defining an inwardly oriented leather side, an outwardly oriented fur side, a nose end and a rear end, the pelt board defining a top end for accommodating and fixating the nose end of the pelt, a circumferential wall for facing the inwardly oriented leather side of the of the pelt and a base end located opposite the top end, providing a stretching apparatus comprising a holding device and a fastening device, the fastening device comprise a gripping mechanism and a drive mechanism, providing a first user interface for controlling the gripping mechanism and a second user interface for controlling the drive mechanism, the first user interface and/or the second user interface being located a distance of less than 30 cm from the gripping mechanism, holding the base end of a pelt board by the holding device, moving the first fastening device relative to the holding device and for positioning the rear end of the pelt within the gripping mechanism by using the second user interface, operating the gripping mechanism by using the first user interface.

The above method may advantageously be used together with the above apparatus.

At least the above object or at least one of numerous further objects which will be evident from the below description of the present invention, is according to one aspect of the present invention obtained by a method of stretching a pelt on a pelt board, the pelt having a substantially tubular shape defining an inwardly oriented leather side, an outwardly oriented fur side, a nose end and a rear end, the pelt board defining a top end for accommodating and fixating the nose end of the pelt, a circumferential wall for facing the inwardly oriented leather side of the pelt and a base end located opposite the top end, the method comprising the steps of:

i) providing a stretching apparatus comprising a holding device, a fastening device comprising a gripping mechanism, and a drive mechanism connected between the holding device and the fastening device, ii) holding the base end of a pelt board by the holding device so that the pelt board extends outwardly along a longitudinal direction from the holding device, iii) fastening the rear end of the pelt by using the gripping mechanism of the fastening device, and iv) moving the holding device and the fastening device relative to each other in the longitudinal direction by using the drive mechanism for applying a stretching force onto the pelt by the drive mechanism corresponding to an estimated maximum stretching force value or more during a total time period of between 5 seconds and 120 seconds, preferably the total time period being greater than 10 seconds, more preferably greater than 20 seconds, most preferably greater than 30 seconds, such as greater than 60 seconds, or ever greater than 90 seconds.

The pelt, the pelt board and how the pelt is mounted on the pelt board, has been described in detail above. The holding device is holding the base end of the pelt board in a fixated position and preferably in a vertical orientation such that the pelt board extends upwardly from the holding device and consequently, the pelt extends on the pelt board from a rear end adjacent the holding device to a nose end pointing upwardly and away from the holding device. The fastening device fastens the rear end of the pelt by the gripping mechanism, preferably circumferentially about the pelt in order to distribute the stretching force.

By moving the holding device and the fastening device in the longitudinal direction and typically towards each other, the pelt will be stretched on the pelt board. As the holding device and the fastening device move the stretching force applied by the drive mechanism onto the pelt will increase until the stretching force assumes an estimated maximum stretching force value which is has a value which is contemplated to be below the force which is safe for the pelt, i.e. sufficiently below the value which is expected to tear the pelt apart or otherwise significantly damaging the pelt, but above the force at which only linear and non-time dependent deformations occur.

The present inventors have found out that in order to maximize the stretching of the pelt a stretching force at which non-linear and time-dependent deformations occur in the pelt may be maintained onto the pelt for an a longer time period than used in the past. In this way not merely the non-time dependent deformation of the pelt is achieved but also the time-dependent deformation.

In the past, each pelt was stretched up to an estimated maximum stretching force which was determined to be a force which all or at least most pelts could withstand taking account the internal strength of the pelt. The pelt was then immediately or within a very short time period of up to a maximum of one or perhaps at most two seconds fastened to the pelt board by appropriate means. The fastening means would traditionally involve using clips whereas today plastic pelt bags are used for the fastening purpose allowing a non-destructive fastening of the pelt to the pelt board.

However, once the pelt is fastened, the maximum length of the pelt is "frozen", i.e. the pelt cannot be any longer that the length achieved when fastened to the pelt board since this would involve a release of the pelt from the pelt board. Naturally, the internal force applied to the pelt in the fixated position may still vary due to time dependent deformation within the pelt, which would cause an elastic deformation to be transformed into a more permanent deformation as described above. Also, the drying of the pelt may induce a deformation force into the pelt. However, the pelt itself cannot be longer after it has been fixated. Any time dependent deformation occurring after the pelt has been fixated will merely contribute to lowering the fixation force of the pelt on the pelt board.

The pelt may be fixated to the pelt board by using a so-called pelt bag as described in the applicant company's Danish patents DK 176683 and DK 177012. Alternative fixation techniques such as the use of a wrapping plastics band, the use of straps or mechanical fixation elements are also contemplated to be within the scope of the present application. In the present context is understood that a pelt bag includes sleeves and similar contraptions capable of fixating the lower end of the pelt to the pelt board. Such pelt bags are typically made of plastic or similar flexible polymeric material. Pelt bags or the like apply a more gentle fixation compared to staples and similar means and thus a pelt may be fastened with a higher internal stretching force without being damaged.

The stretching force should thus result not only in an elastic deformation of the pelt but also a plastic deformation of the pelt as the plastic deformation is of a more permanent nature than the elastic deformation. The elastic deformation yields an internal stress in the pelt which may remain after drying and cause the pelt to contract after drying. After stretching the pelt it is fastened to the pelt board in the stretched condition. The pelt will thus have an internal stress when dried whereby the elastic deformation contributes more to the internal stress than the plastic deformation. The internal stress in the pelt may thus be reduced by allowing the pelt to the stretched to the same length using more plastic deformation and less elastic deformation.

By maintaining the stretching force corresponding to the estimated maximum stretching force value a longer time period, i.e. at least 5 seconds, the time dependent deformation effects in the pelt will have sufficient time to develop and results in achieving a longer pelt before it is being fastened to the pelt board. The estimated maximum stretching force value is contemplated to be a stretching force which all or at least most pelts could withstand taking account the internal strength of the pelt while still being a stretching force at which non-linear and time-dependent deformations occur.

The estimated maximum stretching force value may be estimated by a forecast based on the characteristics of the stretching so far, e.g. based on the length of the pelt and the force applied on the pelt etc. Alternatively, the estimated maximum stretching force value may be based on a prediction which in turn may be based on pelt type, length etc.

According to a further embodiment of the present invention, during the total time period, the stretching force is increasing beyond the estimated maximum stretching force value to an elevated stretching force.

It has been realized by the present inventors that when the time dependent deformation in the pelt occurs, e.g. the plastic deformation, the internal stress in the pelt may be reduced such that the pelt may in fact sustain a higher stretching force than the originally determined estimated maximum stretching force value. Thus, the pelt may be further stretched to an elevated stretching force which is higher than the originally determined estimated maximum stretching force value. Although the elevated stretching force would possibly have damaged the non-stretched pelt, it may be applied to a "pre-conditioned" pelt, i.e. a pelt which have undergone a deformation by being subjected to an estimated maximum stretching force value for a certain time period. Thereby, a longer pelt may be achieved, since the pelt have been subjected to an even higher stretching force prior to being fastened to the pelt board.

Typically, the longer total time period of stretching using the estimated maximum stretching force value or more, the longer the pelt will be, however, the deformation is typically larger at the start of the period and settles when approaching the end of the total time period.

According to a further embodiment of the present invention, the elevated stretching force is between 1% and 100% greater than the estimated maximum stretching force value, preferably between 2% and 25% greater than the estimated maximum stretching force value, more preferably between 3% and 10% greater than the estimated maximum stretching force value, most preferably about 5% greater than the estimated maximum stretching force value.

The above values continue typical values which may be safely used with a "pre-conditioned" pelt, i.e. a pelt which has undergone a deformation by being subjected to an estimated maximum stretching force value for a certain time period.

According to a further embodiment of the present invention, the stretching force substantially maintains the estimated maximum stretching force value during the total time period.

This embodiment may be considered a basic embodiment at which the stretching force assumes the estimated maximum stretching force value and retains this stretching force for the complete total time period specified above.

According to a further embodiment of the present invention, the total time period is interrupted by an intermittent time period during which the stretching force assumes a lower stretching force, the lower stretching force being between 50% and 99% of the estimated maximum stretching force value, preferably between 70% and 95%, more preferably between 80% and 90%.

When the stretching force has reached the estimated maximum stretching force value which corresponds to a force value where from experience and based on the physical data of the pelt (i.e. type, length etc) the hairs of the pelt have not yet to any substantial extent started to loosen and/or the risk that the pelt may tear apart is minimal, the longitudinal movement of the holding device and the fastening device is decreased, stopped or even reversed such that a lower stretching force value is achieved for an intermittent time period, i.e. a time period interrupting the above mentioned total time period.

Thereafter, the stretching force will temporarily assume the lower stretching force which depending on the movement of the holding device and the fastening device will be lower than the estimated maximum stretching force value for eliminating the risk of the pelt being damaged. It should thereby be noted that the damage on the pelt by e.g. tearing or loss of hair will normally occur at the weakest spot in the pelt but will also depend on the stress distribution in the pelt.

This temporary reduction in the stretching force gradient will allow the plastically and elastically deformed parts of the pelt to settle, allow any loosened fibres in the pelt to bond and redistribute internal stress in the pelt. Thus, the strength of the pelt will be slightly increased allowing for a further stretching of the pelt exhibiting a stretching force on the pelt which equals or exceeds the estimated maximum stretching force value, without experiencing any loosening of the hairs of the pelts or any tearing of the pelt. Experiments performed by the applicant indicate that the increase in total length of the pelt by following such cyclic stretching scheme using at least one stretching cycle is 5%-10%, thus more than using a vibration or similar uniform oscillating stretching.

According to a further embodiment of the present invention, the stretching force when reaching the estimated maximum stretching force value decreases substantially instantly to the lower stretching force value and thereafter remains substantially constant during a part of the intermittent time period and thereafter increases to the estimated maximum stretching force value during the remainder of the intermittent time period, or alternatively, the stretching force when reaching the estimated maximum stretching force value remains substantially constant during a greater part of the intermittent time period and thereafter decreases substantially instantly to the lower stretching force value before increasing to the estimated maximum stretching force value, or alternatively, wherein the stretching force when reaching the estimated maximum stretching force value decreases to the lower stretching force value during a part of the intermittent time period and thereafter increasing to the estimated maximum stretching force value during the remainder of the intermittent time period, or alternatively, wherein the stretching force when reaching the estimated maximum stretching force value decreases substantially instantly to the lower stretching force value and thereafter increases to the first estimated maximum stretching force value during the intermittent time period.

Various alternative stretching schemes employing stretching cycles may be employed involving different reductions of the stretching force and/or different time periods of stopping the relative movement of the holding device and the fastening device.

According to a further embodiment of the present invention, the intermittent time period is between 10 milliseconds and 60 seconds, preferably between 100 milliseconds and 3 seconds.

Experimental results of the applicant has shown that the above time periods allow for an optimal stretching of the pelt, i.e. a period of increased stretching force followed by a time period of reduced stretching force.

According to a further embodiment of the present invention, the total time period is interrupted 2-25 times, preferably 3-20 times, more preferably 5-15 times, most preferably 7-12 times.

The increase in maximum stretching force may be 1-5% for each repetition, whereby a longer time period between each of the repetitions will contribute to a longer total pelt and whereby typically any subsequent stretching will result in a smaller additional length for each repetition.

According to a further embodiment of the present invention, the estimated maximum stretching force value causes or is estimated to cause the pelt to deform in a non-linear relationship with the stretching force.

As stated above, to deform in a non-linear relationship with the stretching force include various types of non-elastic deformation such as time dependent deformations e.g. plastic deformation and creep.

According to a further embodiment of the present invention, the estimated maximum stretching force value is between 50% and 99% of a tear force which causes the pelt to tear apart, preferably between 70% and 95%, more preferably between 80% and 90%.

Statistical methods may also be applied to determine the estimated maximum stretching force value to be a stretching force at which a maximum fraction of pelts be statistically damaged, such as 1%, 1‰, or less.

According to a further embodiment of the present invention, a control device connected to the drive mechanism is provided, the control device preferably including a force measurement device.

The movement of the holding device and the stretching device is made by means of the drive mechanism, which may e.g. be a pneumatic or hydraulic drive as well as an electrical motor drive. The drive mechanism is controlled by the control device. The force measurement device of the control device may be connected to e.g. the drive mechanism for continuously monitoring the applied force.

According to a further embodiment of the present invention, the holding device and/or the fastening device comprise a vibration actuator for inducing an oscillation onto the pelt, the vibration actuator operating at a frequency of between 1 Hz and 1 kHz, preferably between 10 Hz and 100 Hz.

In addition to the above mentioned total time period of estimated maximum stretching force value or more, optionally with intermittent interruptions, a vibration actuator may be employed. It is thereby understood that the oscillation frequency of the vibration actuator is higher than the cycle frequency of the above mentioned intermittent interruptions. In this way additionally up to 5% of length of the pelt may be gained by loosening up the pelt using a higher frequency oscillation. The vibration may be employed during the stretching phase when the estimated maximum stretching force value or more or alternatively during the phase in which the stretching force is reduced during the intermittent interruption. The frequency of the vibrator may be higher than 1 Hz such as 10 Hz-100 Hz. Such frequencies are well above the cycle frequency of the above mentioned cyclical scheme and will thus have a different effect on the pelt.

According to a further embodiment of the present invention, the estimated maximum stretching force value is between 100N and 1000N, preferably, between 200N and 800N, more preferably between 300N and 700N, most preferably between 400N and 600N.

The above stretching force of about 300N is suitable as a first stretching for most mink pelts as it will in most cases give an initial increase in length by causing both an elastic as well as plastic deformation of the pelt while it is very unlikely that an otherwise undamaged mink pelt will be damaged during the stretching. It will also give a good forecast for an optional further stretching, i.e. any optional elevated stretching force may be derived from the previous stretching.

According to a further embodiment of the present invention, the stretching apparatus has a pair of stretching members, each of the stretching members being adapted for insertion into a respective front leg cavity of the pelt, the stretching device being movable in a direction towards the holding device for stretching the pelt.

In order to further increase the final length of the pelt, the above stretching scheme may also be employed on the front leg cavities of the pelt, thereby distributing the stretching force over several positions on the pelt.

At least the above object or at least one of numerous further objects which will be evident from the below description of the present invention, is according to one aspect of the present invention obtained by a stretching apparatus for stretching a pelt on a pelt board, the pelt having a substantially tubular shape defining an inwardly oriented leather side, an outwardly oriented fur side, a nose end and a rear end, the pelt board defining a top end for accommodating and fixating the nose end of the pelt, a circumferential wall for facing the inwardly oriented leather side of the of the pelt and a base end located opposite the top end, the stretching apparatus comprising:

- a holding device for holding the base end of the pelt board, the stretching apparatus defining a pelt board space extending outwardly along a longitudinal direction from the holding device for accommodating the pelt board,
- a fastening device comprising a gripping mechanism for fastening the rear end of the pelt, and
- a drive mechanism connected between the holding device and the fastening device for moving the holding device and the fastening device relative to each other in the longitudinal direction and for applying a stretching force onto the pelt by the drive mechanism corresponding to an estimated maximum stretching force value or more during a total time period of between 5 seconds and 120 seconds, preferably the total time period being greater than 10 seconds, more preferably greater than 20 seconds, most preferably greater than 30 seconds, such as greater than 60 seconds, or ever greater than 90 seconds.

It is evident that the above stretching apparatus for stretching a pelt on a pelt board according to the preferred aspect of the present invention may be used with any of the above mentioned methods of stretching a pelt stretching a pelt on a pelt board according to the preferred aspect of the present invention.

Further aspects according to the present invention includes stretching assemblies comprising combinations of pelt boards and a stretching apparatuses as described according to any of the above aspects.

DETAILED DESCRIPTION

Figure 1A:
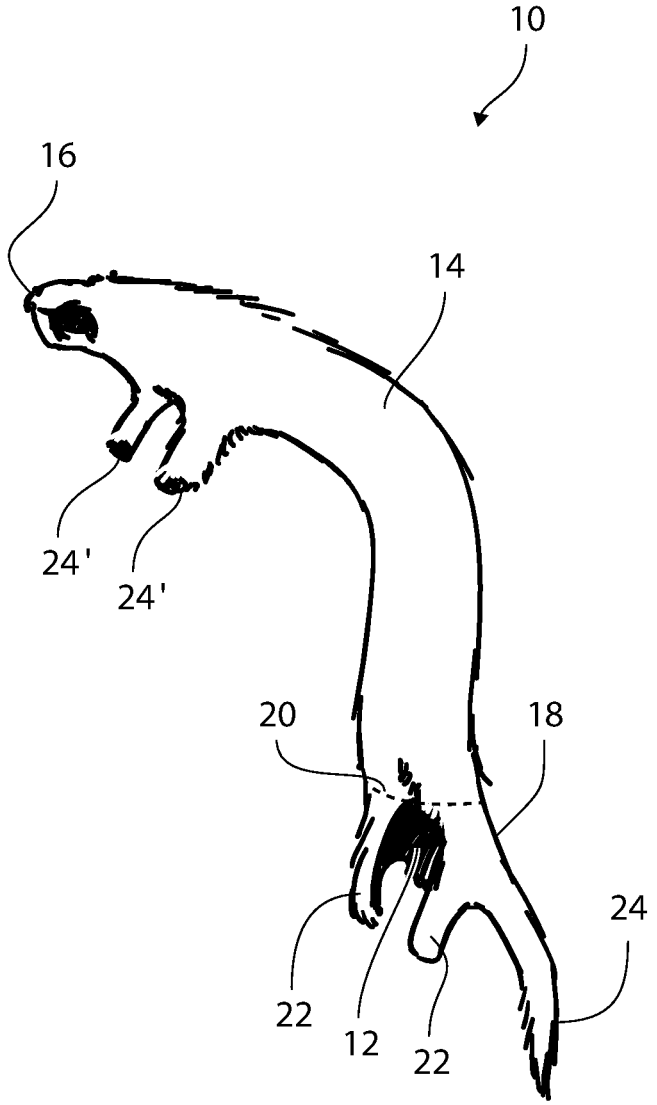
FIG. 1A is a perspective view of a pelt.

FIG. 1A shows a perspective view of a pelt 10. The pelt 10 shown here is of a mink, however, it will be anatomically similar for other small furred mammals such as fox etc. The pelt 10 has a tubular shape and comprises an inwardly oriented leather side 12, an outwardly oriented fur side 14, a nose end 16 and a rear end 18. The rear end 18 defines a contour 20 along the circumference of the tubular pelt 10. The contour 20 may be divided into a leg side contour onto which the rear legs 22 of the pelt are attached and a back side contour onto which a tail part 24 of the pelt 10 is attached.

Figure 1B:
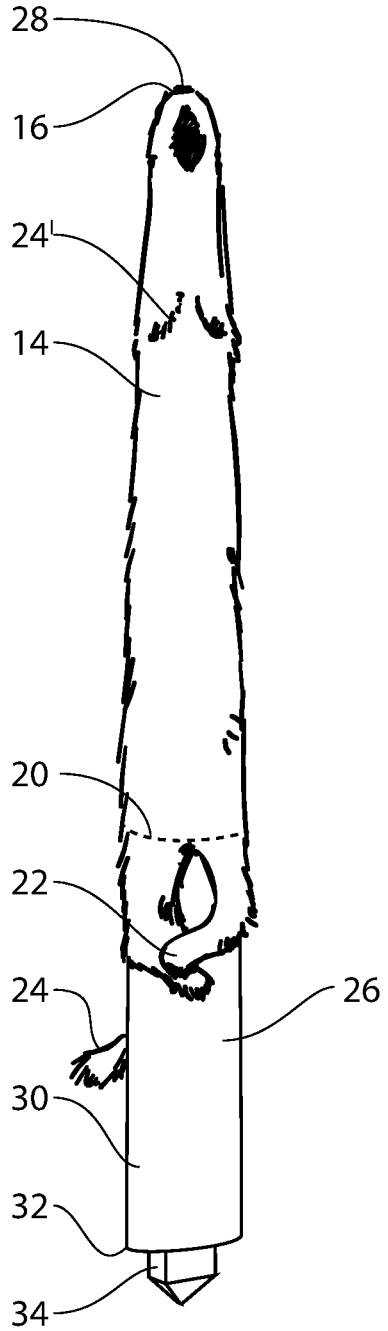
FIG. 1B is a perspective view of the pelt when mounted on a pelt board.

FIG. 1B shows a perspective view of the pelt 10 when mounted on a pelt board. The pelt 20 is mounted on the pelt board 26 such that a top end 28 of the pelt board 30 is accommodating and fixating the nose end 16 of the pelt 10 and the inwardly oriented leather side 12 of the pelt 10 is facing a circumferential wall 30 of the pelt board 10. The pelt board 10 extends in a longitudinal direction from a base end 32 to the top end 28. The base end 32 may be provided with a connecting element 34. The front leg parts have been inverted and are accommodated between the pelt 10 and the pelt board 26, thereby establishing a pair of front leg cavities 24' of the pelt 10 between the nose end 16 and the rear end 18. The pelt board 26 may typically be provided with a fat absorbing and preferably also water absorbing paper (not shown) between the circumferential wall 30 and the inwardly oriented leather side 12.

Figure 1C:
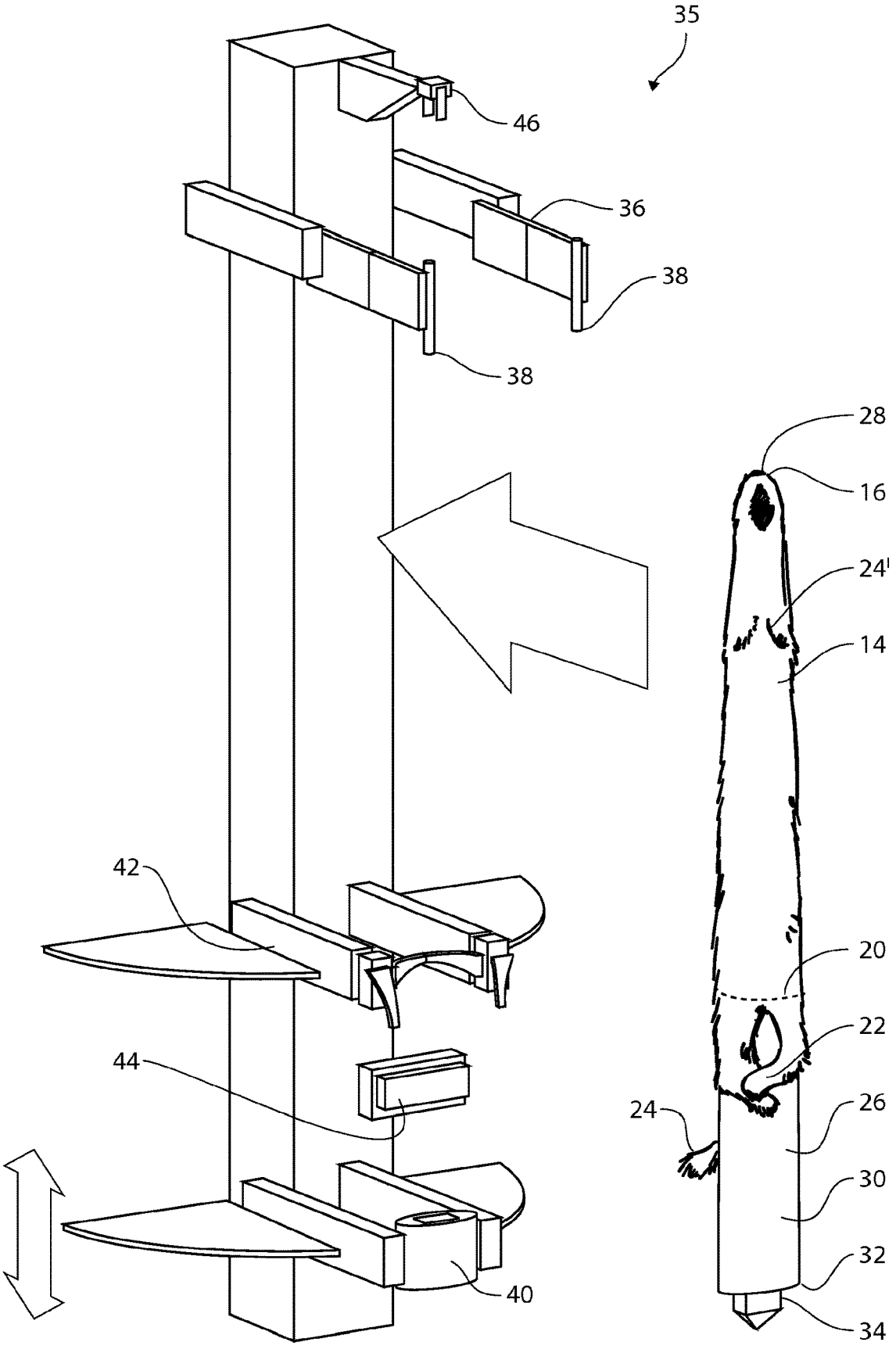
FIG. 1C is a perspective view of the pelt board and a stretching apparatus.

FIG. 1C shows a perspective view of a stretching assembly comprising a pelt board 26 and a stretching apparatus 35. During use, the pelt board 26 is provided with a pelt 10 as described above. The stretching apparatus 35 comprises a stretching device 36 for stretching the upper part of the pelt defined between the nose end 16 and the front leg cavities 24'. The stretching device 36 comprise a pair of cylindrical stretching members 38 which are adapted to be inserted into the front leg cavities 24'.

The stretching apparatus 35 additionally comprises a holding device 40 adapted for holding the base end 32 of the pelt board 26 by fixating the connecting element 34 such that the pelt board 26 extends in a longitudinal direction in the stretching apparatus 35. The stretching apparatus 35 further comprises a first fastening mechanism 42 for fastening the rear end 18 of the pelt 10 along the contour 20, a second fastening mechanism 44 for fastening the tail end 24 of the pelt 10, and a third fastening mechanism 46 for fastening the nose end 16 of the pelt 10. The first fastening mechanism 42 is used for stretching the lower part of the pelt 10 extending between the front leg cavities 24' and the rear end 18 of the pelt. At least the second fastening mechanism 44 and the third fastening mechanism 46 are considered to be optional in the present setup.

Figure 1D:
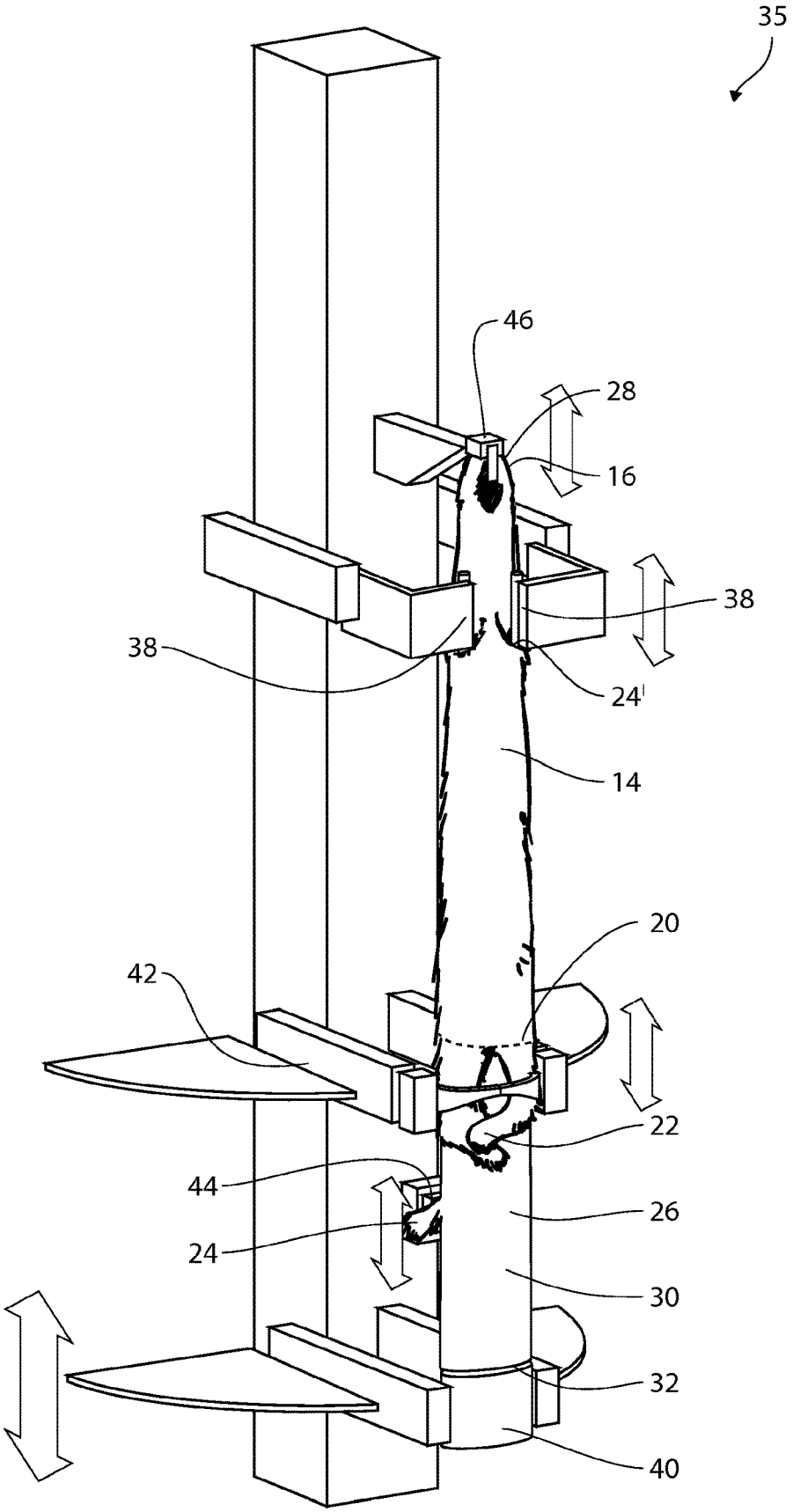
FIG. 1D is a perspective view of the stretching assembly when the pelt is mounted.

FIG. 1D shows a perspective view of a stretching assembly when the pelt 10 has been mounted. All of the holding device 40, stretching device 36, first fastening mechanism 42, second fastening mechanism 44 and third fastening mechanism 46 are movable along the longitudinal direction defined by the pelt board 26 in order to adapt the stretching apparatus 35 to different pelt boards 26 and different pelts 10. This is shown by the arrows.

Figure 1E:
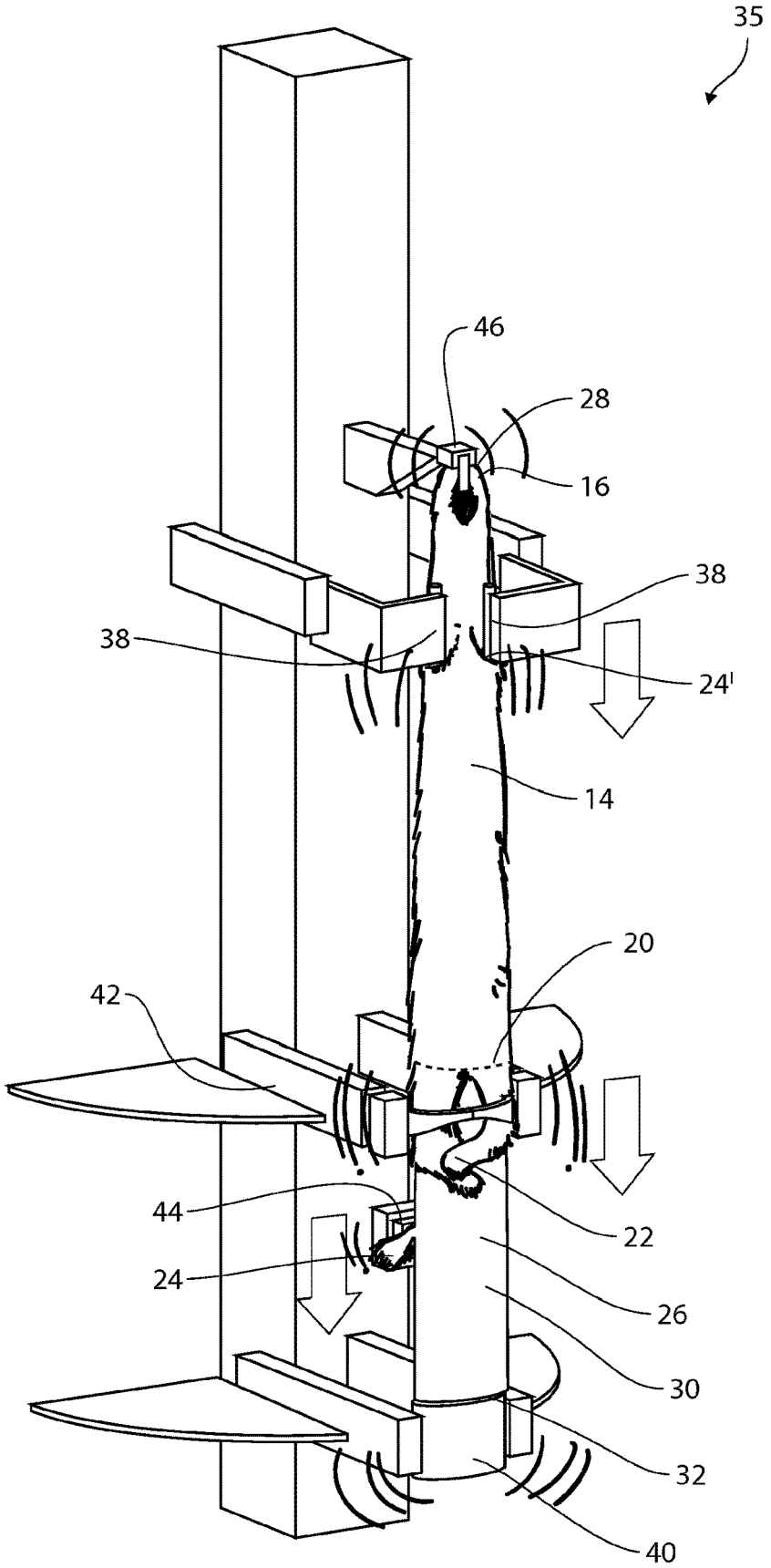
FIG. 1E is a perspective view of the stretching assembly when the stretching starts.

FIG. 1E shows a perspective view of a stretching assembly when the stretching of the pelt 10 starts. The pelt 10 is thereby stretched by causing the stretching device 36, first fastening mechanism 42 and second fastening mechanism 44 to move toward the holding device 40 by means of appropriate drive mechanisms which will be discussed further below. The third fastening mechanism 44 may be caused to move in the opposite direction for relieving the pelt board 26 of pressure. The forces involved for each of the stretching device 36, first fastening mechanism 42, second fastening mechanism 44 and third fastening mechanism 46 are typically in the range of 100-200N. The forces may be applied at a steady magnitude, or alternatively a vibration or oscillation is induced in the pelt, or yet alternatively a combination of the above where e.g. a time period of oscillations is followed by a steady stretching force in order to first loosen the fibres of the pelt 10 and thereafter stretching the fibres of the pelt 10.

Figure 1F:
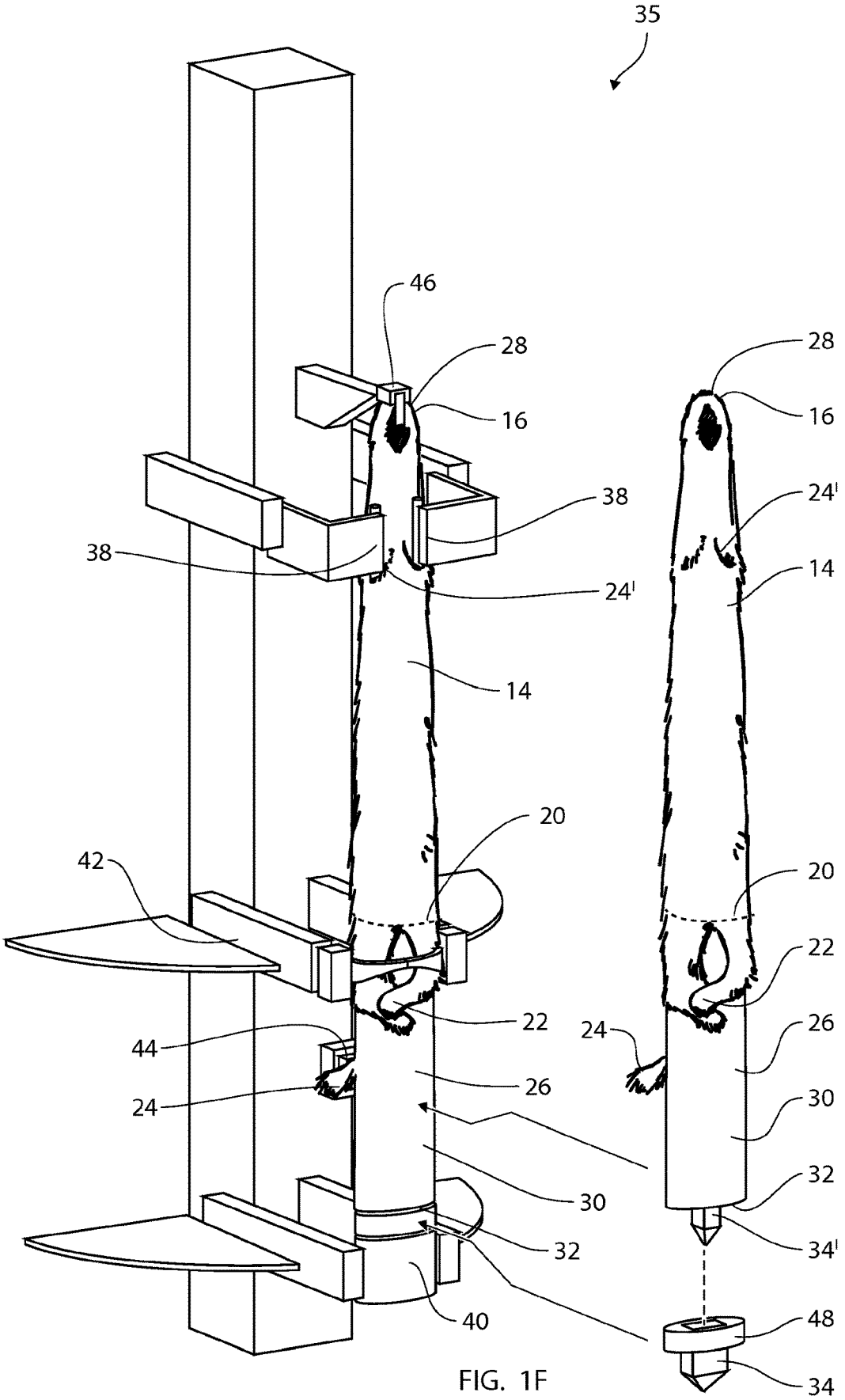
FIG. 1F is a perspective view of the stretching assembly and of an adapter.

FIG. 1F shows a perspective view of a stretching assembly and the optional provision of an adapter 48 which is used for allowing pelt boards 26 having a different sized connecting element 34' to be used in the present stretching assembly 34. The adapter 48 is thereby connected to the different sized connecting element 34' whereby the adapter is provided with the proper sized connecting element 34 for use with the holding device 40 of the stretching apparatus 35.

Figure 2A:
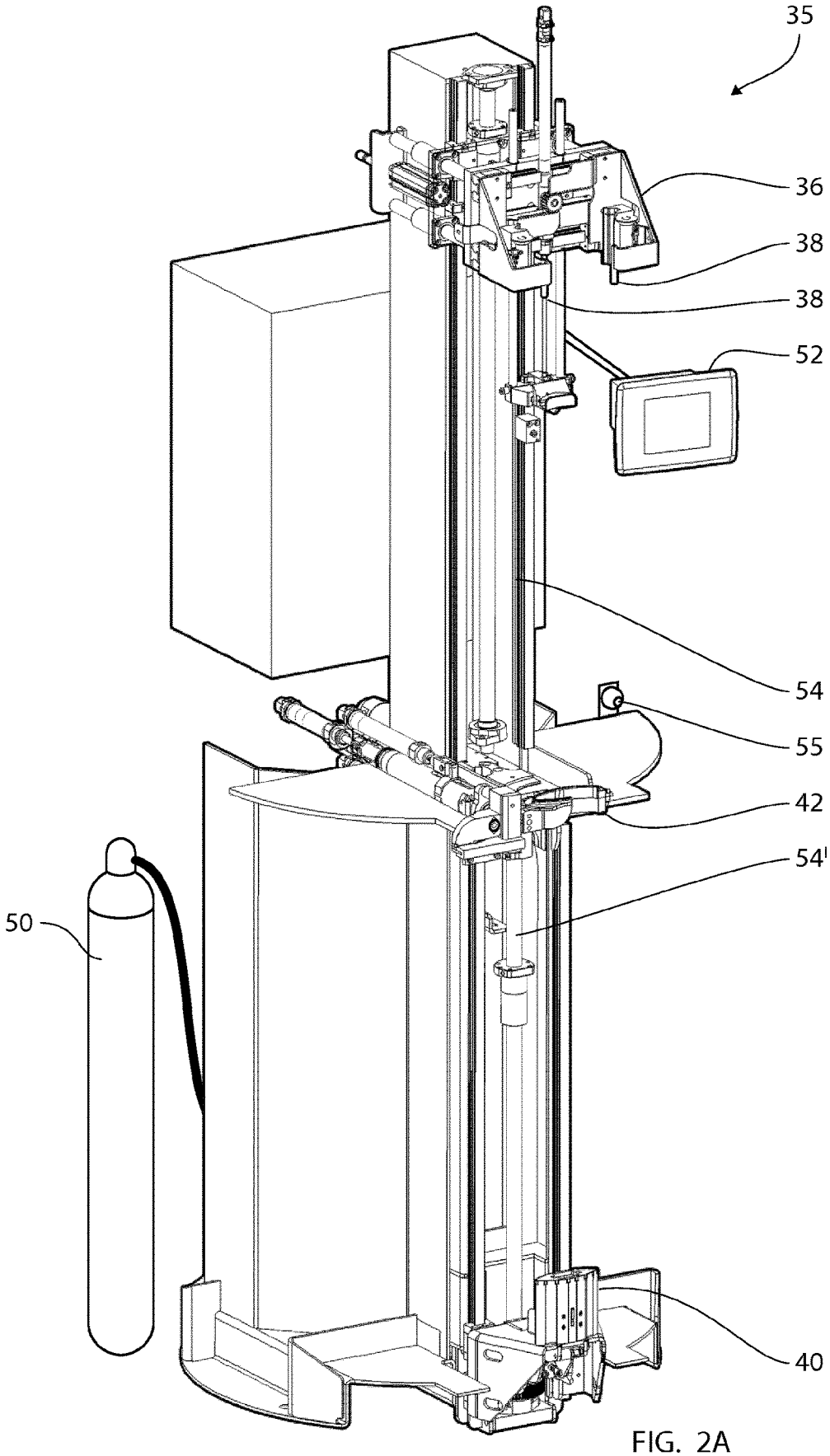
FIG. 2A is a perspective view of a mechanical setup of the stretching apparatus

FIG. 2A shows a perspective view of the mechanical setup of the stretching apparatus 35. The stretching apparatus 35 comprises a compressed air source 50 and a display 52. The stretching device 36 is driven pneumatically and is movable by use of compressed air from the compressed air source 50. The holding device 40 and the first fastening device 42 are mechanically driven by spindle drives 54' and 54, respectively. It is thereby understood that various combinations of drives may be used for the stretching device 36, the holding device 40, the first fastening mechanism 42, the second fastening mechanism 44 and the third fastening mechanism 46.

There is also provided a user interface in the form of a photo detector 55 which is located in close proximity relative to the first fastening device 42 for controlling the fixation and non-fixation positions of the first fastening device 42 while still keeping the hands of the user in contact with the pelt. The photo detector 55 may be replaced by a similar proximity sensor or a detector using other touch free or touch technologies.

Figure 2B:
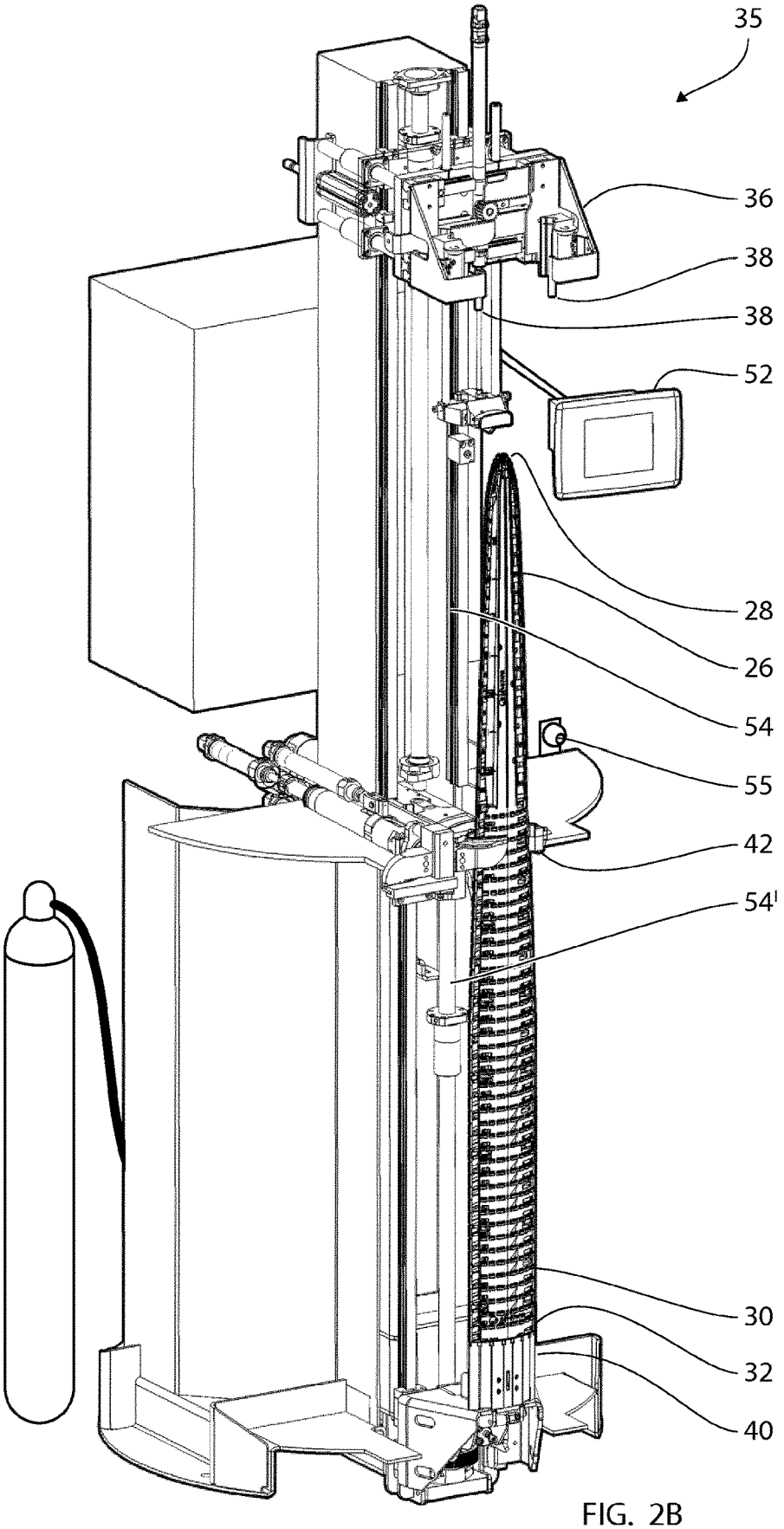
FIG. 2B is a perspective view of the stretching assembly and the pelt board.

FIG. 2B shows a perspective view of the stretching assembly wherein the pelt board 26 is placed in the correct position in the stretching apparatus 35.

Figure 3A:
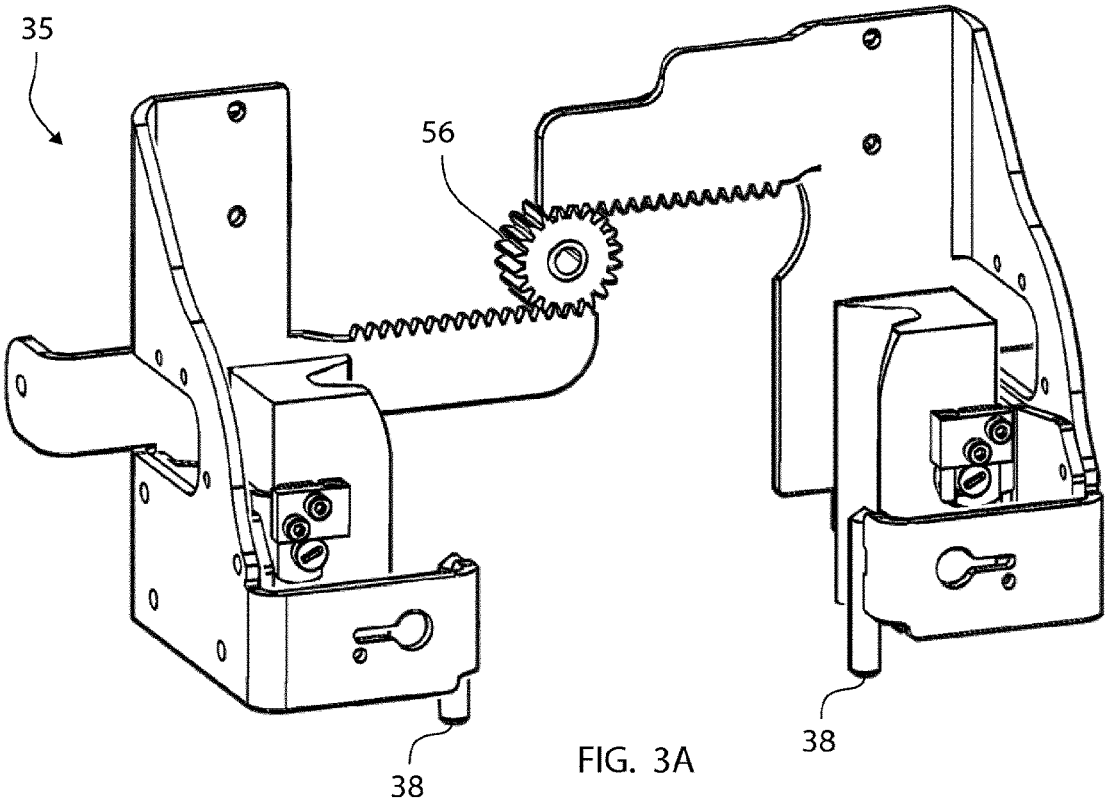
FIG. 3A is a close up view of the stretching device and the rack and pinion actuator.

FIG. 3A shows a close up view of the stretching device 36. The stretching members 38 are interconnected by a rack and pinion actuator 56. This allows the stretching members 38 to move relative to each other to adapt to different sized of pelts 10 having different distances between their front legs.

Figure 3B:
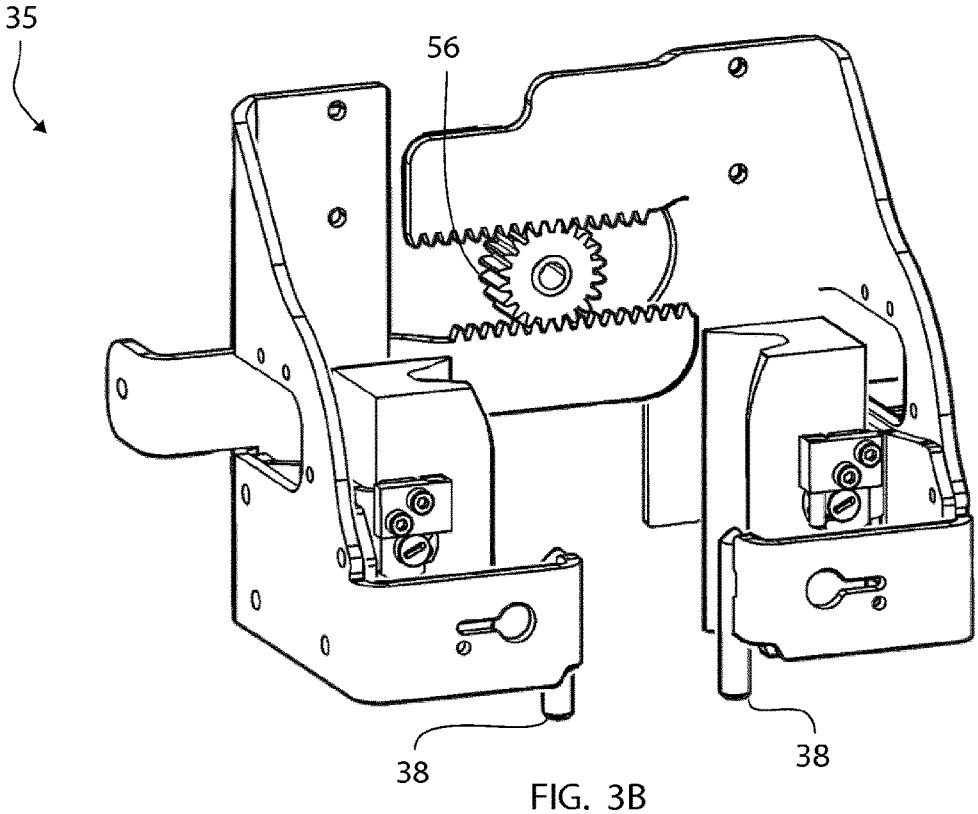
FIG. 3B is a close up view of the stretching device when the rack and pinion actuator is adjusted.

FIG. 3B shows a close up view of the stretching device 36. The stretching members 38 have moved towards each other by means of the rack and pinion actuator 56 in order to adapt to a smaller pelt 10 i.e. having a smaller distance between the front legs.

Figure 4:
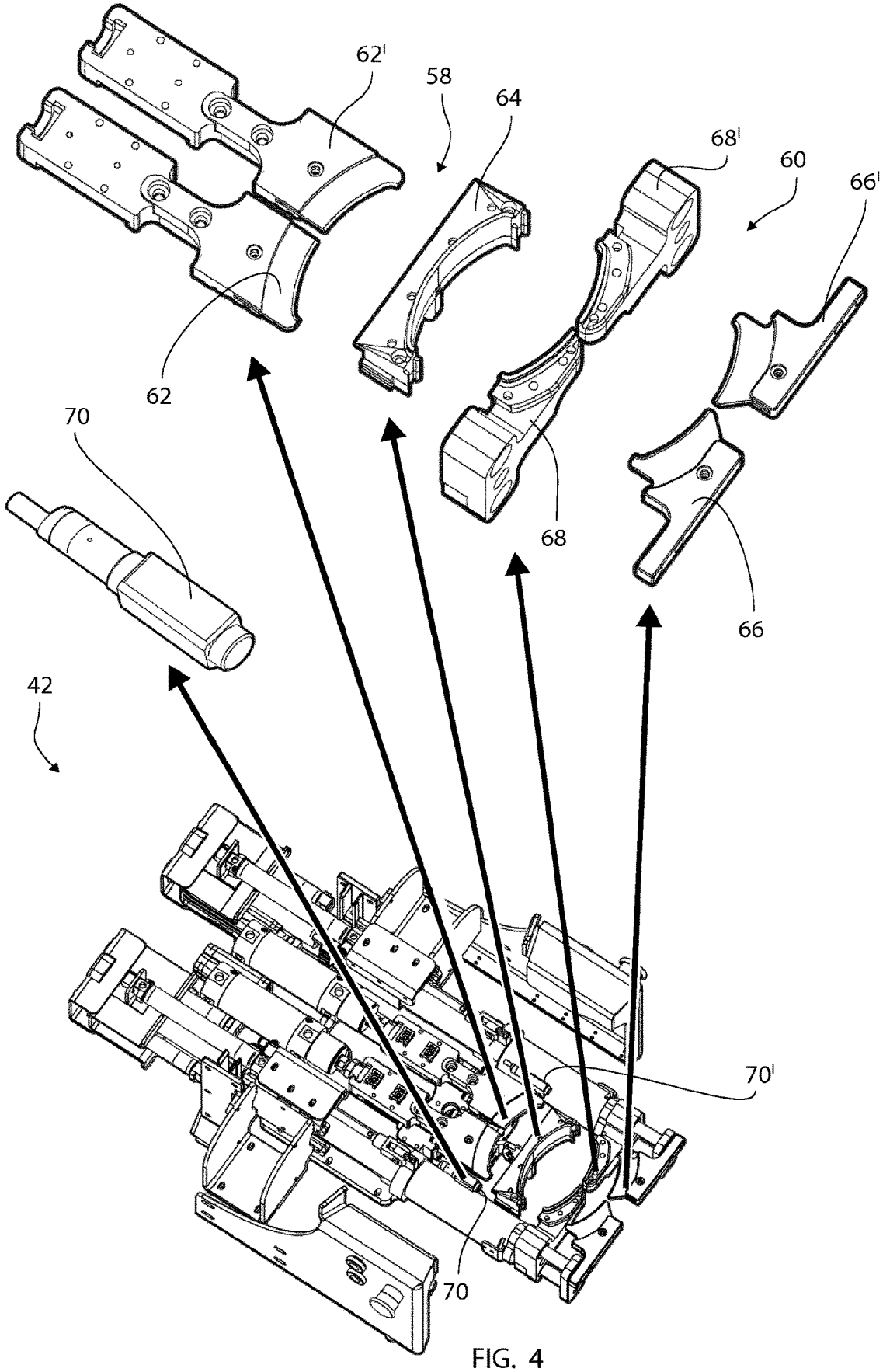
FIG. 4 is a close up view of the first fastening device.

FIG. 4 shows a close up view of the first fastening device 42. The first fastening device 42 comprises a first gripping element 58 for fastening the rear end of the pelt along the back side contour, and a second gripping element 60 for fastening the rear end of the pelt along the leg side contour. The first gripping element 58 comprises a pair of first gripping elements 62 and 62' which are movable in relation to a first holding element 64 for fasten the rear end of the pelt along the back side contour between the gripping elements 62 and 62' and the holding element 64. The holding element 64 may be movable in order to adapt to the pelt board. The second gripping element 60 comprises a pair of second gripping elements 66 and 66' which are movable in relation to a pair of second holding elements 68 and 68' for fastening the rear end of the pelt along the leg side contour between the gripping elements 66 and 66' and the holding elements 68 and 68'. The above gripping or non-gripping operations are performed in a transversal direction in relation to the longitudinal direction defined by the pelt board.

While the gripping or non-gripping operations of the first fastening device 42 are controlled by the above mentioned photo detector, there is further provided a pair of additional photo detectors 70 in close proximity to the first fastening device 42 which are operating as a user interface for the drive mechanism in order to move the fastening device in the longitudinal direction of the pelt board.

Figure 5A:
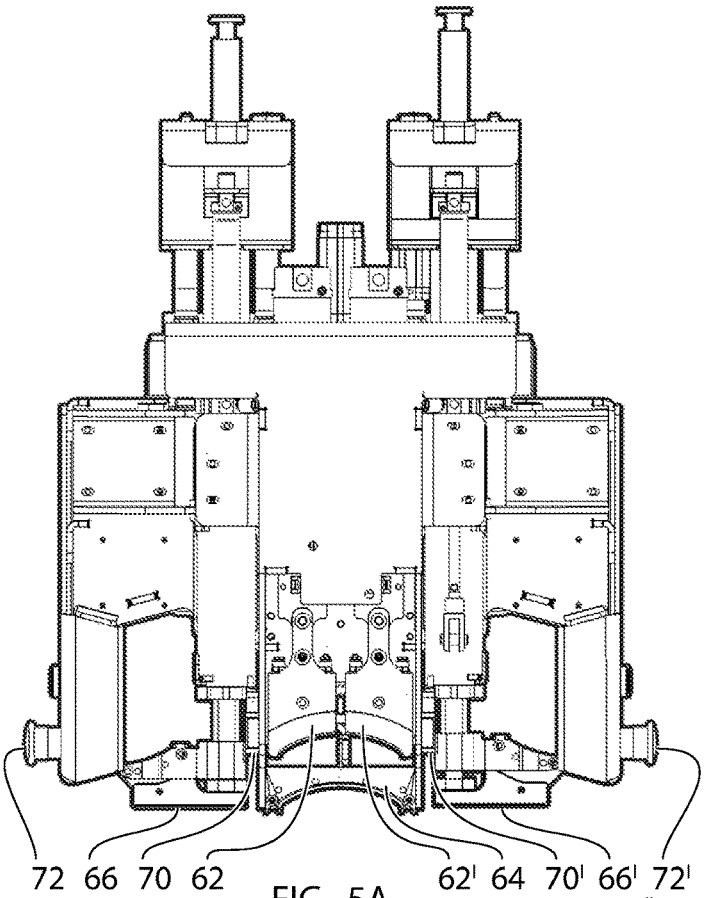
FIG. 5A is a close up view of the first fastening device when in the first position.

FIG. 5A shows a close up view of the first fastening device 42 when in the first position, which is a mounting position of the first gripping mechanism 58. The second gripping mechanism 60 is thereby folded into a non-use position. One of the set of second gripping element 66 and holding element 68 is folded to one side of the first gripping mechanism 58 whereas the other set of second gripping element 66' and holding element 68' are folded to the opposite side of the first gripping mechanism 58. In the present illustrations the pelt board has been removed. It is, however, understood that the pelt board is present in the pelt board space in front of the first gripping mechanism 58 when the stretching apparatus is in use.

Figure 5B:
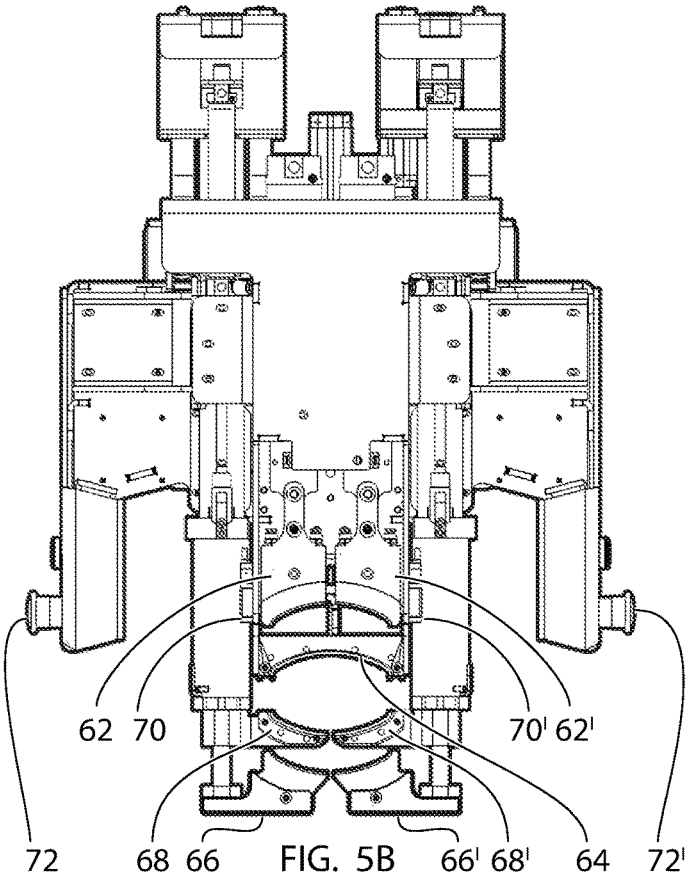
FIG. 5B is a close up view of the first fastening device when in the second position.

FIG. 5B shows a close up view of the first fastening device 42 when the second gripping mechanism 60 has been folded into a use position. The pelt may already have been fixated between the first gripping elements 62 and 62' and the first holding element 64, or alternatively as shown here this step is performed later. The second gripping mechanism 60 including the second gripping elements 66 and 66' and the second holding elements 68 and 68' are thereby first moved in a transverse direction relative to the longitudinal direction of the pelt board and thereafter rotated in order to be located opposite the first gripping mechanism 58 and facing the pelt board space.

Figure 5C:
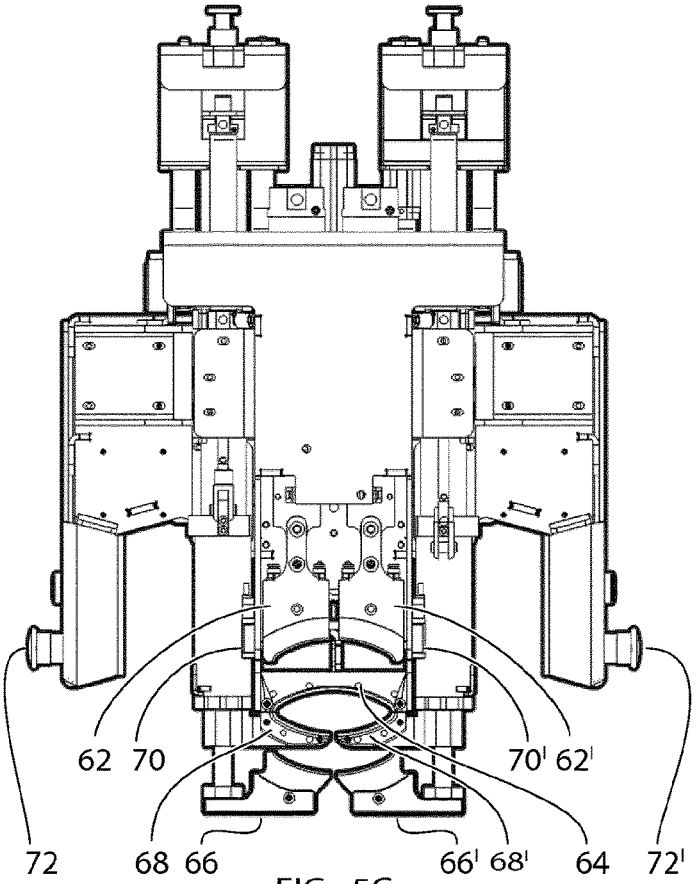
FIG. 5C is a close up view of the holding elements enclosing the pelt board space.

FIG. 5C shows a close up view of the first fastening device 42 when the first holding element 64 and the second holding elements 68 and 68' has been moved towards the pelt board space for enclosing the pelt board.

Figure 5D:
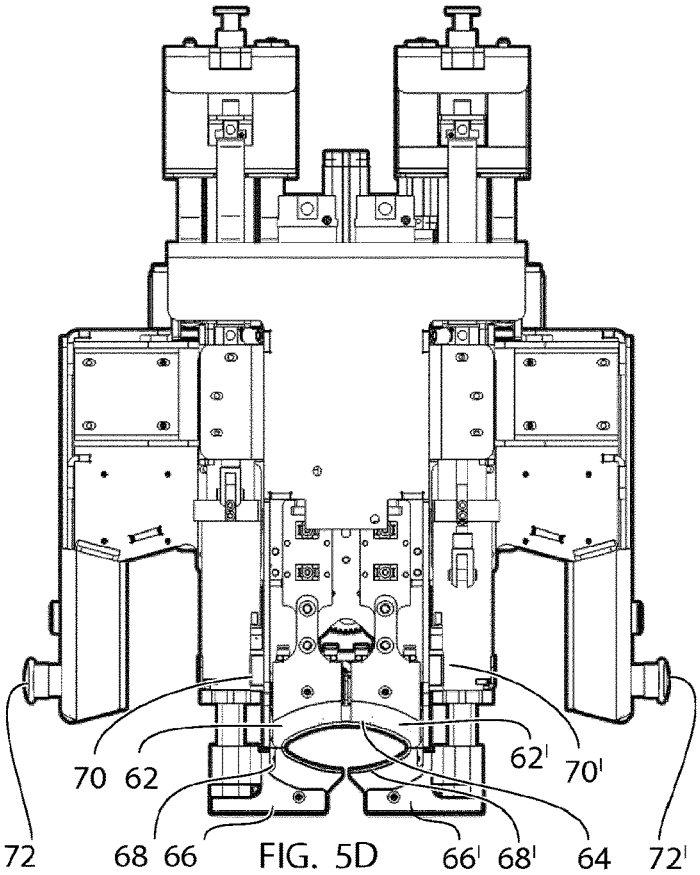
FIG. 5D is a close up view of the fastening of the pelt.

FIG. 5D shows a close up view of the first fastening device 42 when the first gripping elements 62 and 62' have been moved towards the first holding element 64 in order to fasten the rear end of the pelt along the back side contour and the second gripping elements 66 and 66' have been moved towards the second holding elements 68 and 68' in order to fasten the rear end of the pelt along the leg side contour.

Thereafter, the stretching procedure as explained above may be started. Start buttons 72 and 72' may be provided on opposite sides of the first fastening device 42 in order to initiate the stretching procedure. The buttons 72 and 72' must be pressed simultaneously using both hands whereby the risk of personal injury is significantly reduced.

Figure 6A:
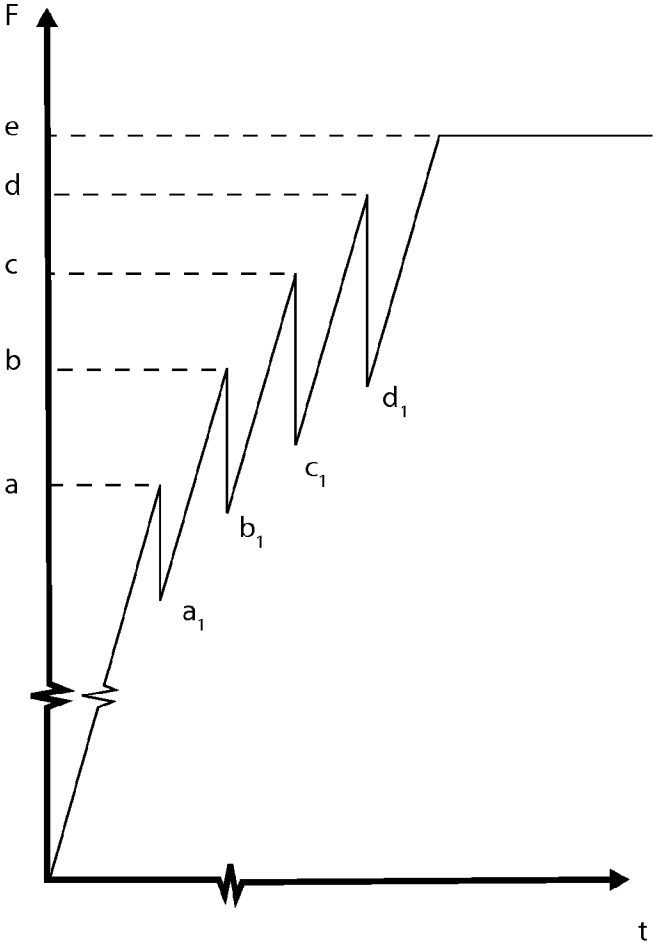
FIG. 6A is a plot of the stretching force vs. time according to a first cyclic scheme.

FIG. 6A shows a plot of the stretching force (F) vs. time (t) according to a first cyclic scheme. According to the present scheme the mutual movement of the holding device and the fastening device induces an increasing stretching force onto the pelt which is fastened on the pelt board. The stretching force is increasing until it reaches the estimated maximum stretching force value designated a, which is the maximum stretching force value in the first cycle. The estimated maximum stretching force value a should be chosen to be a stretching force well below any stretching force which is known to possibly cause damage to the pelt type, while still well above any stretching force which is known to possibly cause only linear, i.e. elastic, deformation. Thus, the estimated maximum stretching force value should cause non-linear deformation. A typical value for the estimated maximum stretching force value is 300N.

Thereafter the stretching force is reduced to a lower stretching force value $a_1$. In practice, the reduction of the stretching force is achieved by reversing the direction of the mutual movement of the holding device and the fastening device such that the stretching force is relaxed. In this way, the pelt may recover in order to be able to withstand a higher stretching force.

As soon as the lower stretching force value has been reached, the stretching force is again increased towards an elevated force value b which corresponds to a maximum stretching force value of a further stretching cycle which is higher than both the original maximum stretching force value a and the lower stretching force value $a_1$. The determination of the elevated force value b may be made based on a forecast of the maximum additional stretching which may be allowed after the first stretching without any significant risk that the pelt will be damaged by e.g. tearing apart or loss of hair. The forecast may be made based on prior experience with the actual pelt type and may additionally be based on factors like the initial length of the pelt and the increase in length achieved by the previous stretch. Typically, the increased force value b is about 500N.

The cyclical stretching scheme may optionally continue with further intermittent stretching force reductions, e.g. b1, c1 and d1, with intermediate stretching force increases, e.g. c, d, and e, for achieving a significant length increase of the pelt compared to the first stretch a.

Figure 6B:
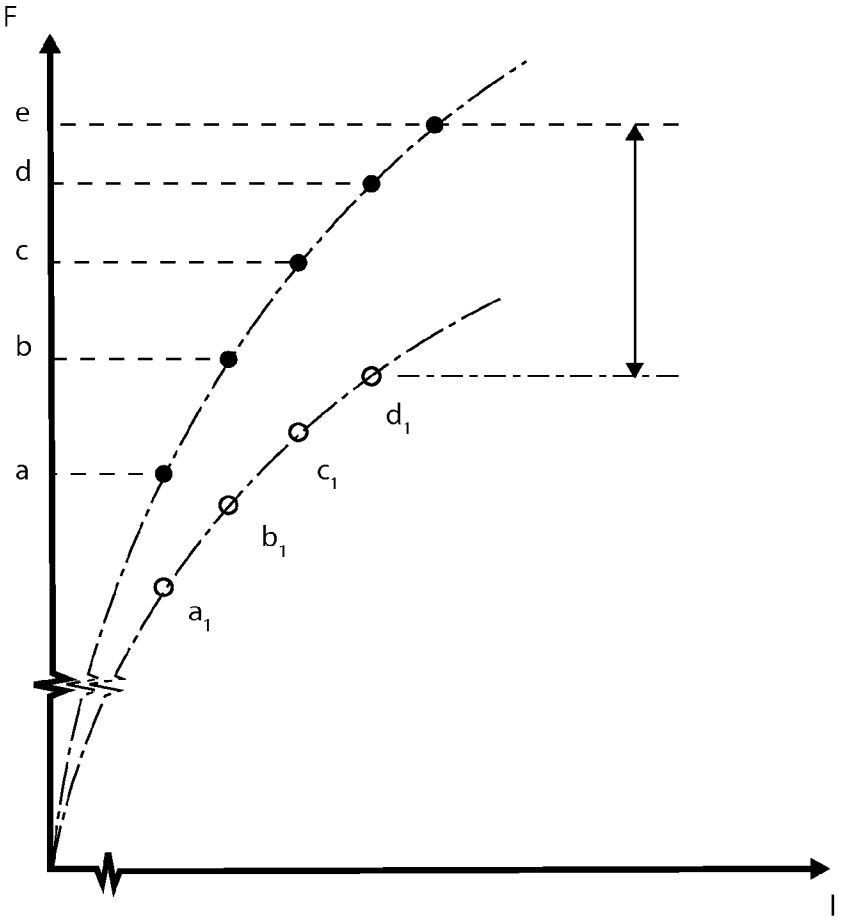
FIG. 6B is a plot of the stretch length vs. stretch force according to the first cyclic scheme.

FIG. 6B shows a plot of the stretching force (F) vs. the plastic deformation (I) according to the first cyclic scheme. The filled circles refer to the maximum stretching force applied in each stretching cycle corresponding to the points a, b, c, d and e of the previous figure, whereas the non-filled circles refer to the minimum stretching force applied in each cycle corresponding to the points $a_1$, $b_1$, $c_1$, and $d_1$ of the previous figure.

As the non-linear deformation of the pelt is permanent, the pelt does not return to its previous length when the stretching force is relaxed. The non-linear deformations, such as plastic deformation, is not linear as the elastic deformation; instead the deformation increases exponentially with higher forces up to a limit where the pelt is torn apart. Thus, when approaching the stretch limit, the stretching force should be increased with small increments.

The present curve may be extrapolated in order to form basis for a forecast of the maximum length which is possible without damaging the pelt. As the gradient of the stretching force (F) vs. the plastic deformation (I) increases the risk of tearing the pelt apart increases. The forecast may be made already after one or possibly two stretching cycles and matched with the established pelt length classes. A pelt should not be stretched more than necessary to reach the lower limit of the next longer class and provided there is a significant risk that the pelt will be damaged before reaching this limit, the pelt should not be stretched any further.

Figure 7B:
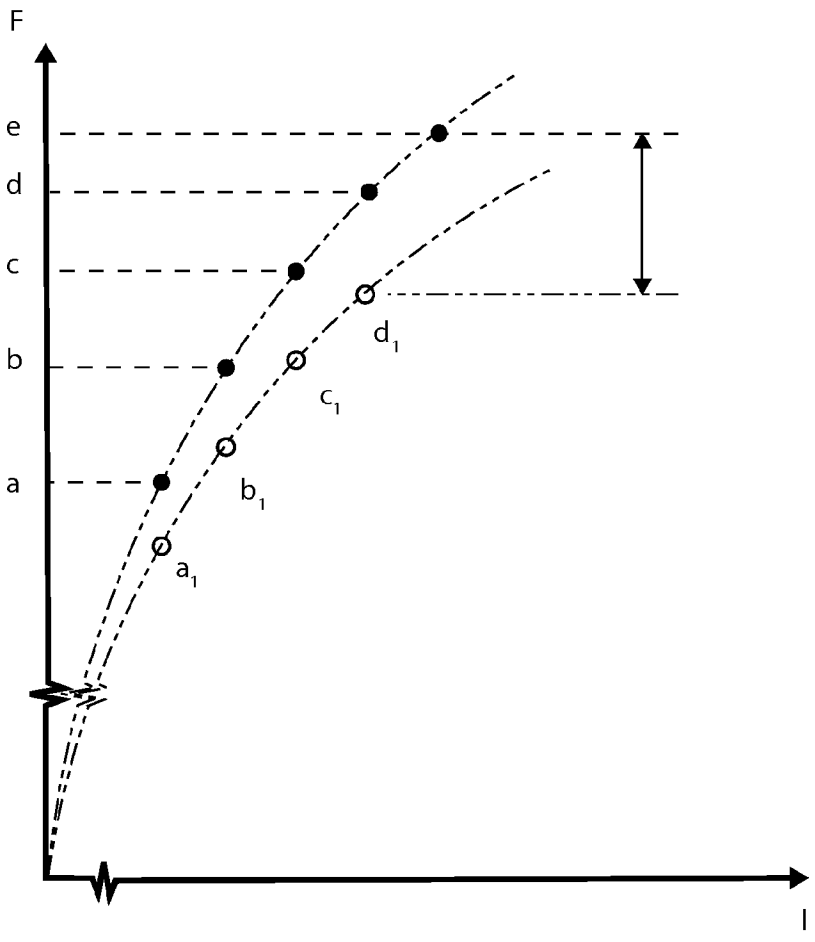
FIG. 7B is a plot of the stretch length vs. stretch force according to the second scheme
Figure 7A:
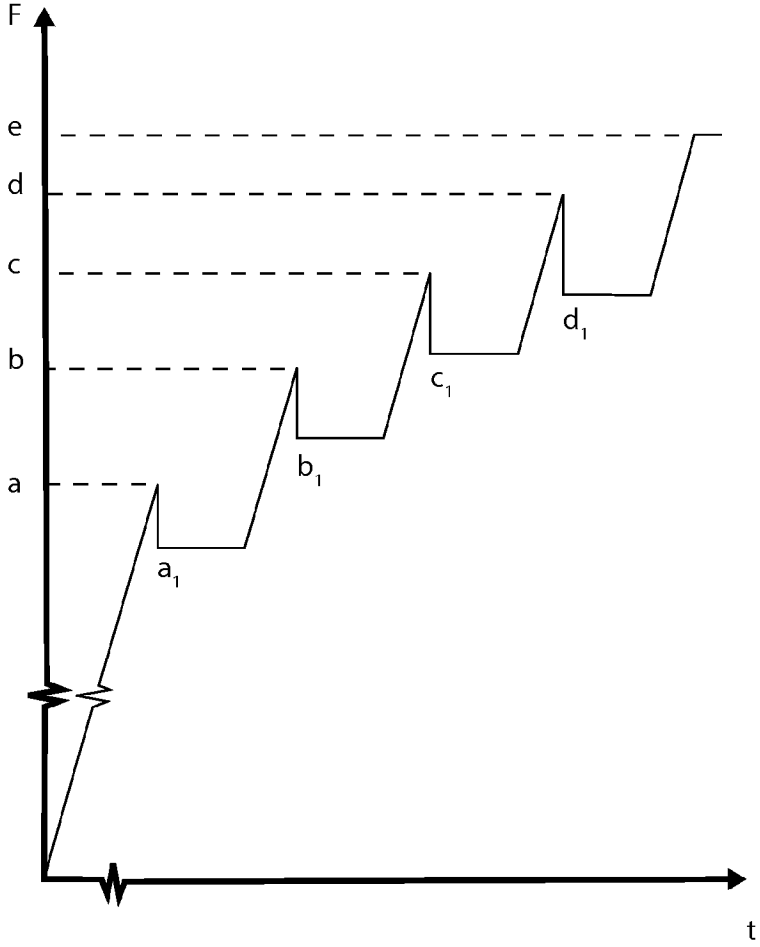
FIG. 7A is a plot of the stretching force vs. time according to a second cyclic scheme.

FIG. 7A shows a plot of the stretching force (F) vs. time (t) according to a second cyclic scheme. The present scheme includes after reaching the estimated maximum stretching force value a period of maintained reduced stretching force during an intermittent time period in order for the pelt to recover. The time period of maintained reduced stretching force before resuming the stretching force increase amounts to typically between 1 and 5 seconds.

FIG. 7B shows a plot of the stretching force (F) vs. the plastic deformation (I) according to the second cyclic scheme, similar to FIG. 6B.

Figure 8B:
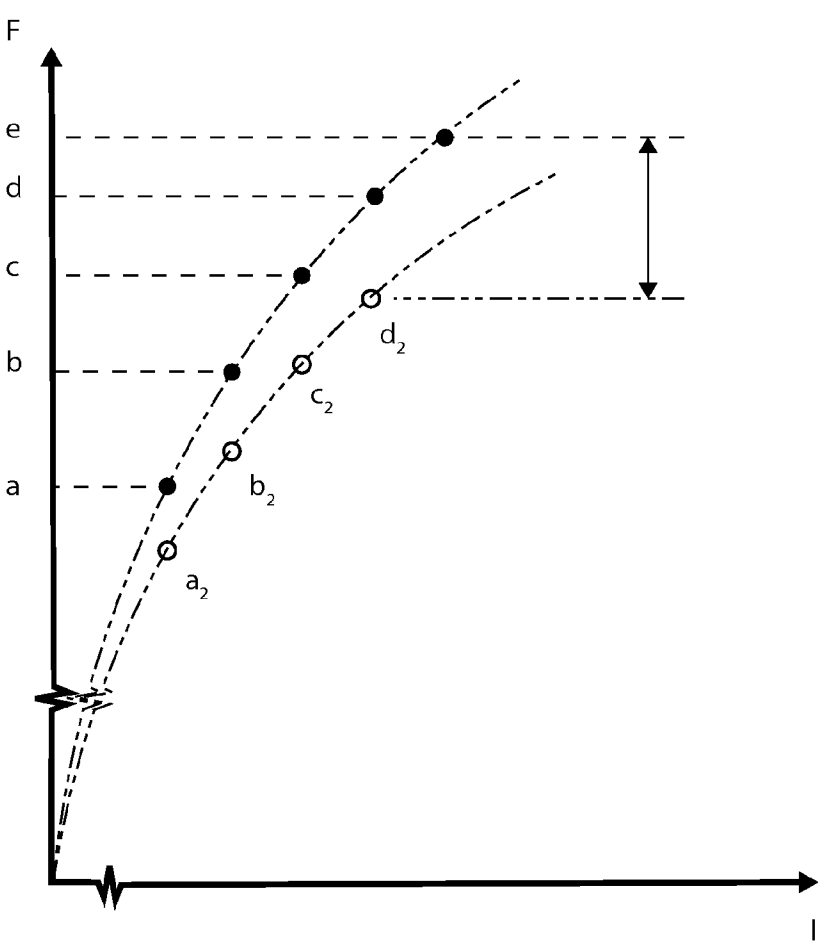
FIG. 8B is a plot of the stretch length vs. stretch force according to the third scheme.
Figure 8A:
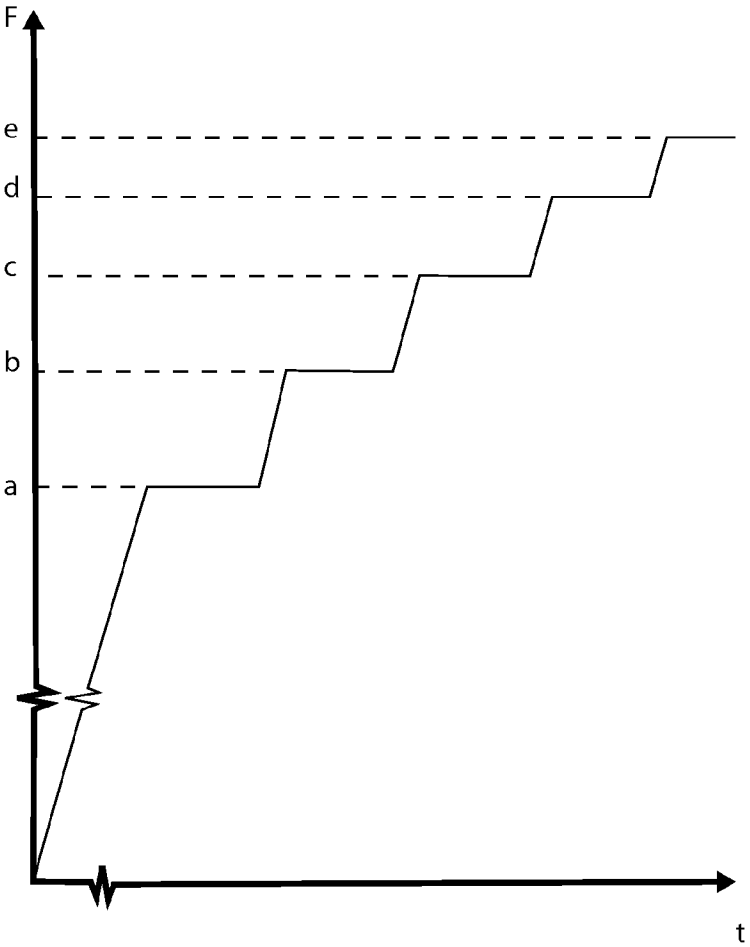
FIG. 8A is a plot of the stretching force vs. time according to a third cyclic scheme

FIG. 8A shows a plot of the stretching force (F) vs. time (t) according to a third cyclic scheme. The present scheme does not include an intermittent reduction of the applied stretching force after reaching the estimated maximum stretching force value but instead includes a period of maintaining the estimated maximum stretching force value in order for the pelt to recover. The time period of maintained stretching force a before the stretching force increases to the elevated force value b amounts to typically between 1 and 5 seconds. Further, as a basic variant, the stretching force is maintained at the stretching force a, i.e. the estimated maximum stretching force value, during the total time period without assuming any elevated force value b.

FIG. 8B shows a plot of the stretching force (F) vs. the plastic deformation (I) according to the third cyclic scheme, similar to FIG. 6B.

Figure 9B:
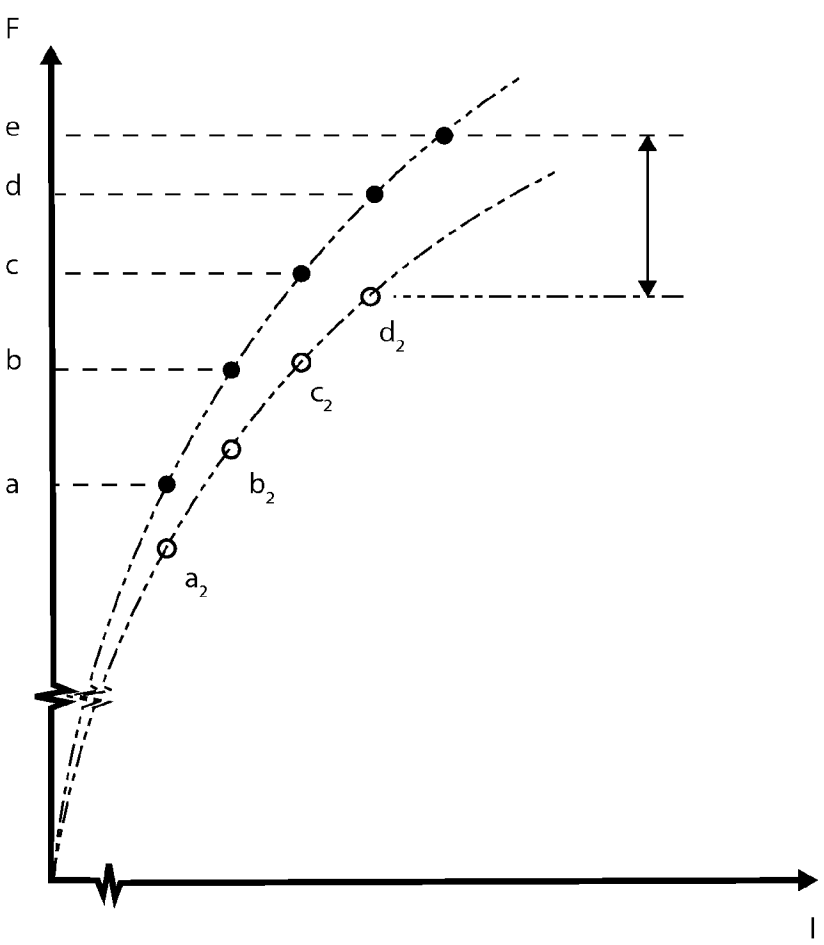
FIG. 9B is a plot of the stretch length vs. stretch force according to the fourth scheme.
Figure 9A:
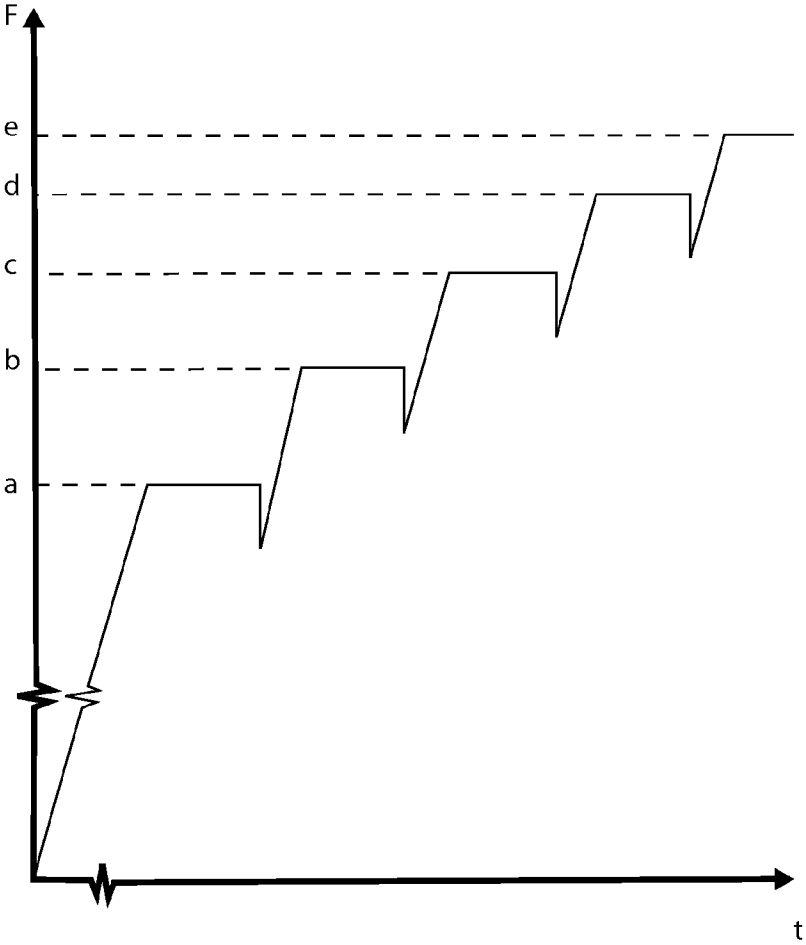
FIG. 9A is a plot of the stretching force vs. time according to a fourth cyclic scheme.

FIG. 9A shows a plot of the stretching force (F) vs. time (t) according to a fourth cyclic scheme. In the present embodiment, the intermittent reduction of the applied stretching force is assumed after a period of maintaining the estimated maximum stretching force value a. Thereafter the stretching force is increased to the estimated maximum stretching force value a and further to the elevated stretching force value b.

FIG. 9B shows a plot of the stretching force (F) vs. the plastic deformation (I) according to the fourth cyclic scheme.

Figure 10B:
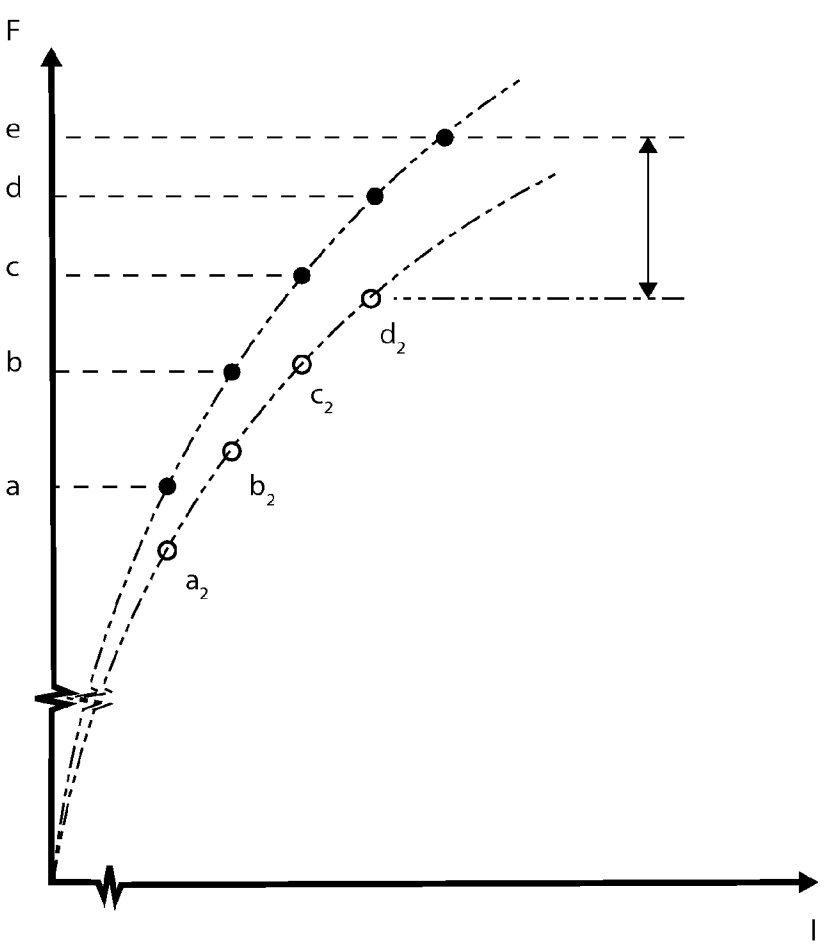
FIG. 10B shows a plot of the stretching force (F) vs. the plastic deformation (I) according to the fifth cyclic scheme.
Figure 10A:
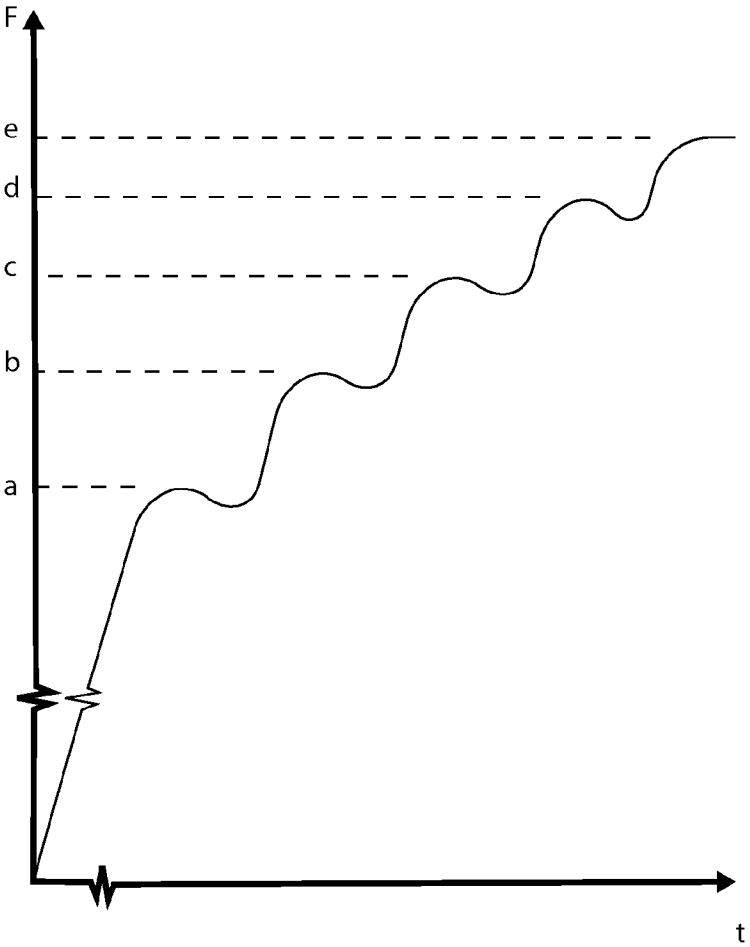
FIG. 10A shows a plot of the stretching force (F) vs. time (t) according to a fifth cyclic scheme.

FIG. 10A shows a plot of the stretching force (F) vs. time (t) according to a fifth cyclic scheme. The fifth scheme involves a continuously varying stretching force.

FIG. 10B shows a plot of the stretching force (F) vs. the plastic deformation (I) according to the fifth cyclic scheme.

Figure 11B:
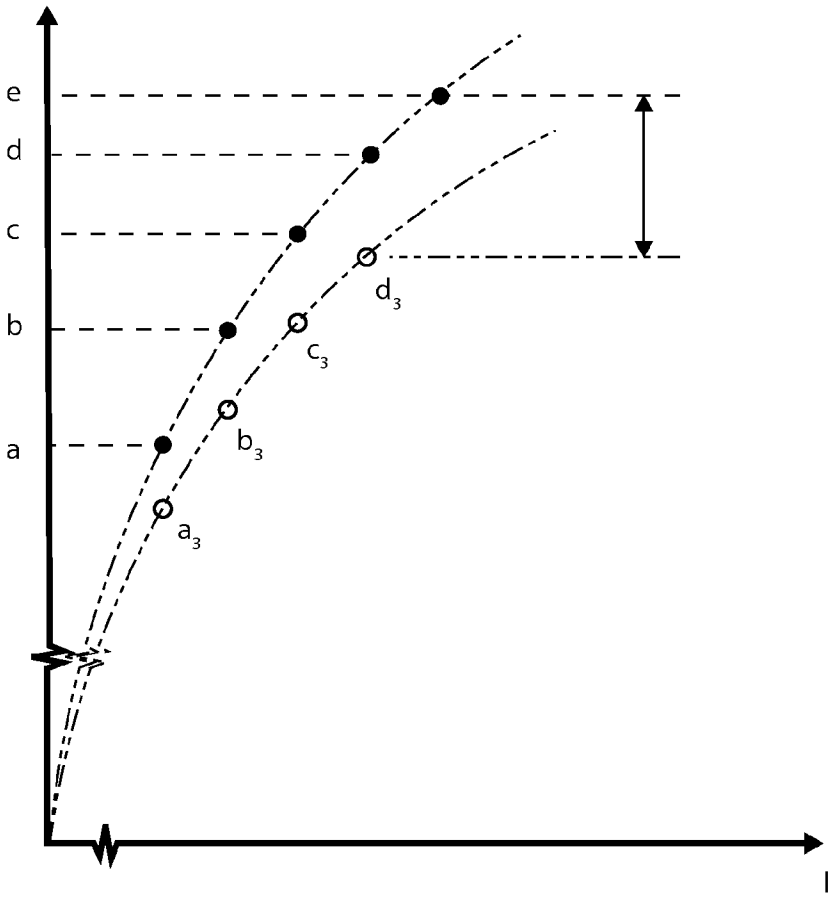
FIG. 11B shows a plot of the stretching force (F) vs. the plastic deformation (I (F) according to the sixth cyclic scheme.
Figure 11A:
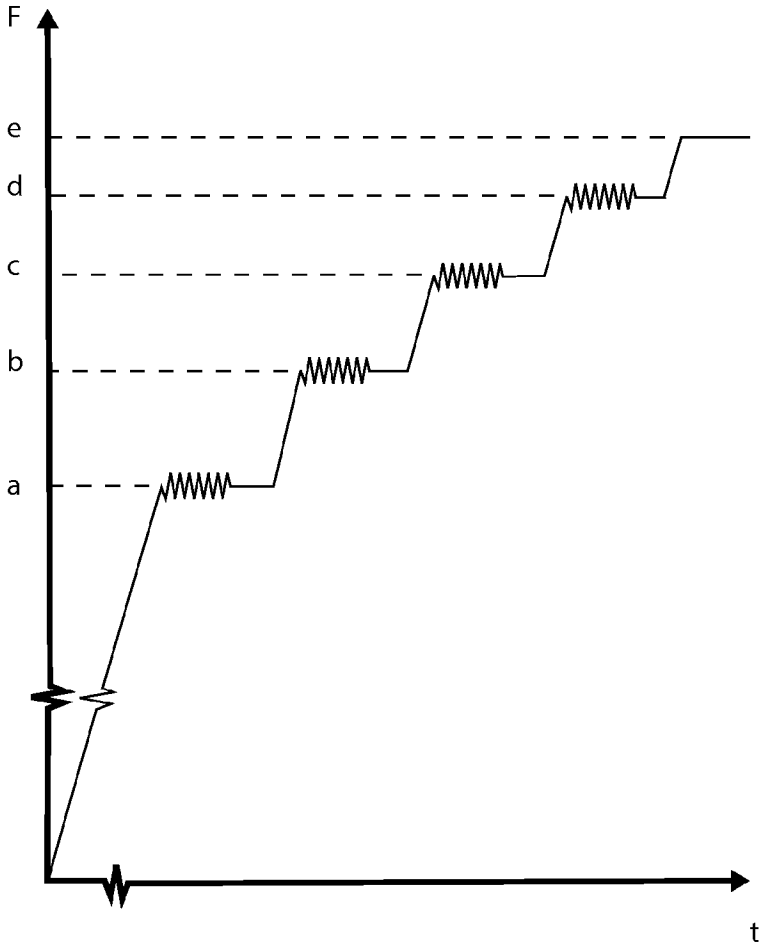
FIG. 11A shows a plot of the stretching force (F) vs. time (t) according to a sixth cyclic scheme.

FIG. 11A shows a plot of the stretching force (F) vs. time (t) according to a sixth cyclic scheme. The present scheme includes a period of maintained stretching force similar to the previous figures, however, including vibrations from a vibration actuator connected to the drive mechanism which in turn moves the holding device and the fastening device relative to each other. The vibrations, which exhibit a substantially higher oscillation frequency than the cycles of the stretching scheme, help to increase the total length of the pelt by loosening the pelt and fibres in the pelt.

FIG. 11B shows a plot of the stretching force (F) vs. the plastic deformation (I (F) according to the sixth cyclic scheme, similar to FIG. 11A.

The present FIGS. 6-11 describe stretching schemes according to various embodiments, which have been tested by the applicant. It is apparent to the skillful individual that numerous other schemes may be derived by amending or combining the above explicitly disclosed variants.

REFERENCE NUMERALS WITH RESPECT TO THE FIGURES

10. Pelt
12. Leather side of the pelt
14. Fur side of the pelt
16. Nose end of the pelt
18. Rear end of the pelt
20. Contour of the pelt
22. Rear leg part of the pelt
24. Front leg part of the pelt
26. Pelt board
28. Top end of the pelt board
30. Circumferential wall of the pelt board
32. Base end of the pelt board
34. Connecting element of the pelt board
35. Stretching apparatus
36. Stretching device
38. Stretching members
40. Holding device
42. First fastening device
44. Second fastening device
46. Third fastening device
48. Adapter
50. Compressed air source
52. Display
54. Spindle drive
55. Photo detector
56. Rack and pinion actuator
58. First gripping mechanism
60. Second gripping mechanism
62. First gripping elements
64. First holding element
66. Second gripping elements
68. Second holding elements
70. Photo detector
72. Start button

Points

The following sets of points constitute subject matter which in relation to the present patent application remains unclaimed but which may be considered patentable separately or in combination with the presently claimed invention.

First set of points:

1. A stretching apparatus for stretching a pelt on a pelt board, said pelt having a substantially tubular shape defining an inwardly oriented leather side, an outwardly oriented fur side, a nose end, a rear end and a pair of front leg cavities, said pelt board defining a top end for accommodating and fixating said nose end of said pelt, a circumferential wall for facing said inwardly oriented leather side of said of said pelt and a base end located opposite said top end, said stretching apparatus comprising:
   - a holding device for holding said base end of said pelt board, and
   - a stretching device having a pair of stretching members, each of said stretching members being adapted for being inserted into a respective front leg cavity of said pelt, said stretching device being movable in a direction towards said holding device for stretching said pelt.
2. The stretching apparatus according to point 1, wherein said stretching members comprise cylindrical pins.
3. The stretching apparatus according to any of the preceding points, wherein said apparatus comprising a first fastening device for fastening said rear end of said pelt, said first fastening device being movable in a direction towards said holding device for stretching said pelt.
4. The stretching apparatus according to any of the preceding points, wherein said apparatus comprising a second fastening device for fastening a tail part extending from said rear end of said pelt, said second fastening device being movable in a direction towards said holding device for stretching said pelt.
5. The stretching apparatus according to any of the preceding points, wherein said apparatus comprising a third fastening device for fastening and fixating said nose end of said pelt, said third fastening device being movable in a direction towards said holding device for stretching said pelt.
6. The stretching apparatus according to any of the preceding points, wherein said stretching device, said first fastening device and/or said second fastening device and/or said third fastening device is/are movable by means of a pneumatic drive, a hydraulic drive or a spindle drive.

7. The stretching apparatus according to any of the preceding points, wherein said first fastening device and/or said second fastening device comprise opposing gripping members for gripping said pelt between said inwardly oriented leather side and said outwardly oriented fur side.
8. The stretching apparatus according to any of the preceding points, wherein said holding device, said stretching device, said first fastening device, said second fastening device and/or said third fastening device comprise one or more vibration actuators for inducing one or more oscillations onto said pelt.
9. The stretching apparatus according to point 8, wherein said vibration actuator operates at a frequency of between 1 Hz and 100 Hz.
10. The stretching apparatus according to any of the preceding points, wherein said stretching device, said first fastening device, said second fastening device and/or said third fastening device comprise a compressed air outlet for temporarily removing any fur hair located adjacent said compressed air outlet.
11. The stretching apparatus according to any of the preceding points, wherein said stretching apparatus further comprises a holding bag applicator
12. The stretching apparatus according to any of the preceding points, wherein said base end of said pelt board comprises a connecting element and said holding device comprises a locking part for locking said connecting element to said holding device.
13. The stretching apparatus according to any of the preceding points, wherein said pair of stretching members are interconnected by a rack and pinion actuator.
14. A stretching apparatus for stretching a pelt on a pelt board, said pelt having a substantially tubular shape defining an inwardly oriented leather side, an outwardly oriented fur side, a nose end, a rear end and a pair of front leg cavities, said pelt board defining a top end for accommodating and fixating said nose end of said pelt, a circumferential wall for facing said inwardly oriented leather side of said of said pelt and a base end located opposite said top end, said pelt further defining a contour constituting a leg side contour and a back side contour, said stretching apparatus comprising:
   a holding device for holding said base end of said pelt board, said stretching apparatus defining a pelt board space extending outwardly along a longitudinal direction from said holding device for accommodating said pelt board,
   a stretching device having a pair of stretching members, each of said stretching members being adapted for being inserted into a respective front leg cavity of said pelt, said stretching device being movable in a direction towards said holding device for stretching said pelt, and
   a fastening device, said fastening device comprise a first gripping mechanism for fastening said rear end of said pelt along either said back side contour or said leg side contour, and a second gripping mechanism for fastening said rear end of said pelt along either said leg side contour or said back side contour, respectively, said first gripping mechanism and said second gripping mechanism being movable in said longitudinal direction and said second gripping mechanism additionally being movable between a first position in which said first gripping mechanism and said second gripping mechanism are located on the same side of said pelt board space, and a second position in which said first gripping mechanism and said second gripping mechanism are located on opposite sides of said pelt board space.
15. A method of stretching a pelt on a pelt board comprising performing the steps of:
   providing said pelt and said pelt board, said pelt having a substantially tubular shape defining an inwardly oriented leather side, an outwardly oriented fur side, a nose end, a rear end and a pair of front leg cavities, said pelt board defining a top end for accommodating and fixating said nose end of said pelt, a circumferential wall for facing said inwardly oriented leather side of said of said pelt and a base end located opposite said top end,
   providing a stretching apparatus comprising a holding device and a stretching device, said stretching device having a pair of stretching members,
   holding said base end of a pelt board by said holding device,
   inserting each of said stretching members of said stretching device into a respective front leg cavity of said pelt, and
   moving said stretching device in a direction towards said holding device, thereby stretching said pelt.

Second set of points:

1. A stretching apparatus for stretching a pelt on a pelt board, said pelt having a substantially tubular shape defining an inwardly oriented leather side, an outwardly oriented fur side, a nose end and a rear end, said pelt board defining a top end for accommodating and fixating said nose end of said pelt, a circumferential wall for facing said inwardly oriented leather side of said of said pelt and a base end located opposite said top end, said pelt further defining a contour constituting a leg side contour and a back side contour, said stretching apparatus comprising:
   a holding device for holding said base end of said pelt board, said stretching apparatus defining a pelt board space extending outwardly along a longitudinal direction from said holding device for accommodating said pelt board, and
   a fastening device, said fastening device comprise a first gripping mechanism for fastening said rear end of said pelt along either said back side contour or said leg side contour, and a second gripping mechanism for fastening said rear end of said pelt along either said leg side contour or said back side contour, respectively, said first gripping mechanism and said second gripping mechanism being movable in said longitudinal direction and said second gripping mechanism additionally being movable between a first position in which said first gripping mechanism and said second gripping mechanism are located on the same side of said pelt board space, and a second position in which said first gripping mechanism and said second gripping mechanism are located on opposite sides of said pelt board space.
2. The stretching apparatus according to point 1, wherein said first gripping mechanism fastens said rear end of said pelt along said back side contour and said second gripping mechanism fastens said rear end of said pelt along said leg side contour.
3. The stretching apparatus according to any of the preceding points, wherein said first gripping mechanism and/or said second gripping mechanism comprise a gripping element and an opposite holding element, said gripping element being movable in relation to said holding element in order to pin said rear end of said pelt between said gripping element and said holding element.

4. The stretching apparatus according to any of the preceding points, wherein said second gripping mechanism comprises a first half part and a second half part, each half part being adapted for gripping approximately a quarter of said contour.
5. The stretching apparatus according to point 4, wherein when in said first position, said first half part and a second half part are located on opposite sides of said pelt board space.
6. The stretching apparatus according to any of the preceding points, wherein the movement between said first position and said second position involves a linear movement and a rotational movement of said second gripping mechanism.
7. The stretching apparatus according to any of the preceding points, wherein said holding device and/or said fastening device comprise a vibration actuator for inducing an oscillation onto said pelt.
8. The stretching apparatus according to point 7, wherein said vibration actuator operates at a frequency of between 1 Hz and 100 Hz.
9. The stretching apparatus according to any of the preceding points, wherein said stretching apparatus further comprises a holding bag applicator.
10. The stretching apparatus according to any of the preceding points, wherein said base end of said pelt board comprises a connecting element and said holding device comprises a locking part for locking said connecting element to said holding device.
11. The stretching apparatus according to any of the preceding points, wherein said fastening device comprises a compressed air outlet for temporarily removing any fur hair located adjacent said compressed air outlet.
12. The stretching apparatus according to any of the preceding points, wherein said holding device and/or said fastening device is movable by means of a pneumatic drive, a hydraulic drive or a spindle drive.
13. The stretching apparatus according to any of the preceding points, wherein said fastening device comprises a laser for generating a visual alignment line on said pelt.
14. A stretching apparatus for stretching a pelt on a pelt board, said pelt having a substantially tubular shape defining an inwardly oriented leather side, an outwardly oriented fur side, a nose end, a rear end and a pair of front leg cavities, said pelt board defining a top end for accommodating and fixating said nose end of said pelt, a circumferential wall for facing said inwardly oriented leather side of said of said pelt and a base end located opposite said top end, said pelt further defining a contour constituting a leg side contour and a back side contour, said stretching apparatus comprising:
   a holding device for holding said base end of said pelt board, said stretching apparatus defining a pelt board space extending outwardly along a longitudinal direction from said holding device for accommodating said pelt board,
   a stretching device having a pair of stretching members, each of said stretching members being adapted for being inserted into a respective front leg cavity of said pelt, said stretching device being movable in a direction towards said holding device for stretching said pelt, and
   a fastening device, said fastening device comprising a first gripping mechanism for fastening said rear end of said pelt along either said back side contour or said leg side contour, and a second gripping mechanism for fastening said rear end of said pelt along either said leg side contour or said back side contour, respectively, said first gripping mechanism and said second gripping mechanism being movable in said longitudinal direction and said second gripping mechanism additionally being movable between a first position in which said first gripping mechanism and said second gripping mechanism are located on the same side of said pelt board space, and a second position in which said first gripping mechanism and said second gripping mechanism are located on opposite sides of said pelt board space.
15. A method of stretching a pelt on a pelt board, said pelt having a substantially tubular shape defining an inwardly oriented leather side, an outwardly oriented fur side, a nose end and a rear end, said pelt board defining a top end for accommodating and fixating said nose end of said pelt, a circumferential wall for facing said inwardly oriented leather side of said of said pelt and a base end located opposite said top end, said pelt further defining a contour constituting a leg side contour and a back side contour, said method comprising the steps of:
   providing a stretching apparatus comprising a holding device and a fastening device, said fastening device comprising a first gripping mechanism and a second gripping mechanism,
   holding said base end of a pelt board by said holding device so that said pelt board extends outwardly along a longitudinal direction from said holding device,
   moving said first gripping mechanism and said second gripping mechanism along said longitudinal direction,
   fastening said rear end of said pelt along either said back side contour or said leg side contour by using said first gripping mechanism,
   moving said second gripping mechanism from an initial first position in which said first gripping mechanism and said second gripping mechanism are located on the same side of said pelt board to a second position in which said first gripping mechanism and said second gripping mechanism are located on opposite sides of said pelt board, and
   fastening said rear end of said pelt along either said leg side contour or said back side contour, respectively.

Third set of points:

1. A stretching apparatus for stretching a pelt on a pelt board, said pelt having a substantially tubular shape defining an inwardly oriented leather side, an outwardly oriented fur side, a nose end and a rear end, said pelt board defining a top end for accommodating and fixating said nose end of said pelt, a circumferential wall for facing said inwardly oriented leather side of said of said pelt and a base end located opposite said top end, said stretching apparatus comprising:
   a holding device for holding said base end of said pelt board, and
   a fastening device comprising a gripping mechanism for fastening said rear end of said pelt, said fastening device further comprising a drive mechanism for moving said first fastening device relative to said holding device and for positioning said rear end of said pelt within said gripping mechanism, said gripping mechanism being controlled by a first user interface and said drive mechanism being controlled by a second user interface, said first user interface and/or said second user interface being located a distance of less than 30 cm from said gripping mechanism.

2. The stretching apparatus according to point 1, wherein said first user interface and/or said second user interface is located less than 30 cm from said gripping mechanism, preferably less than 20 cm, more preferably less than 10 cm, most preferably less than 5 cm.
3. The stretching apparatus according to any of the preceding points, wherein said first user interface and/or said second user interface comprise a proximity sensor, such as a photo detector or an IR sensor.
4. The stretching apparatus according to any of the preceding points, wherein said first user interface and/or said second user interface comprise a pressure sensor, a resistive sensor or a capacitive sensor.
5. The stretching apparatus according to any of the preceding points, wherein said second user interface comprises a first sensor for causing said drive mechanism to move said fastening device away from said holding device, and a second sensor for causing said drive mechanism to move said fastening device towards said holding device.
6. The stretching apparatus according to any of the preceding points, wherein said distance between said gripping mechanism and said holding mechanism is unobstructed and/or said stretching apparatus enables a human user to simultaneously reach both said gripping mechanism and said holding mechanism by the same hand.
7. The stretching apparatus according to any of the preceding points, wherein said holding device and/or said fastening device comprise a vibration actuator for inducing an oscillation onto said pelt.
8. The stretching apparatus according to point 7, wherein said vibration actuator operates at a frequency of between 1 Hz and 100 Hz.
9. The stretching apparatus according to any of the preceding points, wherein said stretching apparatus further comprises a holding bag applicator.
10. The stretching apparatus according to any of the preceding points, wherein said base end of said pelt board comprises a connecting element and said holding device comprises a locking part for locking said connecting element to said holding device.
11. The stretching apparatus according to any of the preceding points, wherein said fastening device comprises a compressed air outlet for temporarily removing any fur hair located adjacent said compressed air outlet.
12. The stretching apparatus according to any of the preceding points, wherein said holding device and/or said fastening device is movable by means of a pneumatic drive, a hydraulic drive or a spindle drive.
13. The stretching apparatus according to any of the preceding points, wherein said fastening device comprises opposing gripping members for gripping said pelt between said inwardly oriented leather side and said outwardly oriented fur side.
14. The stretching apparatus according to any of the preceding points, wherein said fastening device comprises a laser for generating a visual alignment line on said pelt.
15. A method of stretching a pelt on a pelt board comprising performing the steps of:

providing said pelt and said pelt board, said pelt having a substantially tubular shape defining an inwardly oriented leather side, an outwardly oriented fur side, a nose end and a rear end, said pelt board defining a top end for accommodating and fixating said nose end of said pelt, a circumferential wall for facing said inwardly oriented leather side of said of said pelt and a base end located opposite said top end, providing a stretching apparatus comprising a holding device and a fastening device, said fastening device comprising a gripping mechanism and a drive mechanism, providing a first user interface for controlling said gripping mechanism and a second user interface for controlling said drive mechanism, said first user interface and/or said second user interface being located a distance of less than 30 cm from said gripping mechanism, holding said base end of a pelt board by said holding device, moving said first fastening device relative to said holding device and positioning said rear end of said pelt within said gripping mechanism by using said second user interface, and operating said gripping mechanism by using said first user interface.

The invention claimed is:

1. A method of stretching a pelt on a pelt board, said pelt having a substantially tubular shape defining an inwardly oriented leather side, an outwardly oriented fur side, a nose end including a pair of front leg cavities, and a rear end; said pelt board comprising a top end configured for accommodating and fixating said nose end of said pelt, a circumferential wall configured for facing said inwardly oriented leather side of said pelt, and a base end located opposite said top end, said method comprising the steps of:

i) providing a stretching apparatus comprising a holding device, a fastening device comprising a gripping mechanism, and a drive mechanism connected between said holding device and said fastening device;

ii) holding said base end of a pelt board by said holding device so that said pelt board extends outwardly along a longitudinal direction from said holding device;

iii) fastening said rear end of said pelt by using said gripping mechanism of said fastening device; and iv) moving said holding device and said fastening device relative to each other in said longitudinal direction by using said drive mechanism for applying a stretching force to said pelt by said drive mechanism corresponding to at least an estimated maximum stretching force value during a total time period of between 5 seconds and 120 seconds, wherein said total time period is interrupted by an intermittent time period during which said stretching force assumes a lower stretching force, said lower stretching force being between 50% and 99% of said estimated maximum stretching force value.

2. The method according to claim 1, wherein during said total time period, said stretching force is increased beyond said estimated maximum stretching force value to an elevated stretching force.

3. The method according to claim 2, wherein said elevated stretching force is between 1% and 100% greater than said estimated maximum stretching force value.

4. The method according to claim 1, wherein said stretching force substantially maintains said estimated maximum stretching force value during said total time period.

5. The method according to claim 1, wherein said stretching force, upon reaching said estimated maximum stretching force value, decreases to said lower stretching force value and thereafter remains substantially constant during a part of said intermittent time period, and thereafter increases to said estimated maximum stretching force value during the remainder of said intermittent time period.

6. The method according to claim 1, wherein said stretching force, upon reaching said estimated maximum stretching force value, remains substantially constant during a greater part of said intermittent time period and thereafter decreases to said lower stretching force value before increasing to said estimated maximum stretching force value.

7. The method according to claim 1, wherein said stretching force, upon reaching said estimated maximum stretching force value, decreases to said lower stretching force value during a part of said intermittent time period and thereafter increases to said estimated maximum stretching force value during the remainder of said intermittent time period.

8. The method according to claim 1, wherein said stretching force, upon reaching said estimated maximum stretching force value, decreases to said lower stretching force value and thereafter increases to said estimated maximum stretching force value during said intermittent time period.

9. The method according to claim 1, wherein said intermittent time period is between 10 milliseconds and 60 seconds.

10. The method according to claim 1, wherein said total time period is interrupted 2-25 times.

11. The method according to claim 1, wherein said estimated maximum stretching force value causes said pelt to deform in a non-linear relationship with said stretching force.

12. The method according to claim 1, wherein said estimated maximum stretching force value is between 50% and 99% of a tear force which causes said pelt to tear apart.

13. The method according to claim 1, further comprising the step of measuring the force applied to said pelt by said drive mechanism.

14. The method according to claim 1, further comprising the step of inducing an oscillation to said pelt at a frequency of between 1 Hz and 1 kHz.

15. The method according to claim 1, wherein said estimated maximum stretching force value is between 100N and 1000N.

16. The method according to claim 1, wherein said stretching apparatus includes a pair of stretching members, each of said stretching members being configured for insertion into a respective front leg cavity of said pelt, said stretching device being movable in a direction towards said holding device for stretching said pelt.

17. A stretching apparatus for stretching a pelt on a pelt board, said pelt having a substantially tubular shape defining an inwardly oriented leather side, an outwardly oriented fur side, a nose end including a pair of front leg cavities, and a rear end; said pelt board defining a top end configured for accommodating and fixating said nose end of said pelt, a circumferential wall configured for facing said inwardly oriented leather side of said of said pelt, and a base end located opposite said top end, said stretching apparatus comprising:

a holding device configured for holding said base end of said pelt board, wherein a pelt board space extends outwardly along a longitudinal direction from said holding device for accommodating said pelt board;

a fastening device comprising a gripping mechanism configured for fastening said rear end of said pelt, and a pair of stretching members, each of said stretching members being configured for insertion into a respective front leg cavity of said pelt; and a drive mechanism connected between said holding device and said fastening device and configured for moving said holding device and said fastening device relative to each other in said longitudinal direction so as to apply a stretching force to said pelt.

* * * * *